US012269699B2

(12) United States Patent
Tardy et al.

(10) Patent No.: US 12,269,699 B2
(45) Date of Patent: Apr. 8, 2025

(54) SPLICING APPARATUS AND METHOD FOR A PAPERBOARD PROTECTIVE CORNER MANUFACTURING SYSTEM

(71) Applicant: ABZAC CANADA INC., Quebec (CA)

(72) Inventors: Jean Tardy, Quebec (CA); Samuel Lagotte, Quebec (CA); Laurent Dudoit, Quebec (CA)

(73) Assignee: ABZAC CANADA INC. (CA)

( * ) Notice: Subject to any disclaimer, the term of this patent is extended or adjusted under 35 U.S.C. 154(b) by 0 days.

(21) Appl. No.: 18/698,470

(22) PCT Filed: Aug. 31, 2023

(86) PCT No.: PCT/CA2023/051156
§ 371 (c)(1),
(2) Date: Apr. 4, 2024

(87) PCT Pub. No.: WO2024/044856
PCT Pub. Date: Mar. 7, 2024

(65) Prior Publication Data

US 2024/0262647 A1 Aug. 8, 2024

Related U.S. Application Data

(60) Provisional application No. 63/374,077, filed on Aug. 31, 2022.

(51) Int. Cl.
*B65H 19/18* (2006.01)

(52) U.S. Cl.
CPC . *B65H 19/1852* (2013.01); *B65H 2301/4622* (2013.01); *B65H 2301/4631* (2013.01)

(58) Field of Classification Search
None
See application file for complete search history.

(56) References Cited

U.S. PATENT DOCUMENTS 4,655,865 A 4/1987 Nozaka
5,217,561 A * 6/1993 Ueda ..... B32B 38/0036 219/508

(Continued)

FOREIGN PATENT DOCUMENTS

CA 2459828 C 12/2008
CA 2518983 C 9/2011

(Continued)

OTHER PUBLICATIONS

International Search Report issued in PCT/CA2023/051156.

(Continued)

*Primary Examiner* — Michael N Orlando
*Assistant Examiner* — Abhishek A Patwardhan
(74) *Attorney, Agent, or Firm* — The Belles Group, P.C.

(57) ABSTRACT

A splicing apparatus for splicing together an engaged paper sheet with a replenishing paper sheet in a paperboard corner manufacturing system, the apparatus comprising: an engaged sheet holder for holding the engaged paper sheet; an engaged sheet cutter for cutting the engaged paper sheet to form a free engaged paper end; a replenishing sheet holder for holding the replenishing paper sheet; a replenishing sheet cutter for cutting the replenishing paper sheet to form a free replenishing paper end; a sheet end alignment device for positioning both free engaged and replenishing paper ends relative to each other and substantially aligned with each other; an adhesive tape applicator for applying an adhesive tape simultaneously to the aligned free engaged and replenishing paper ends such that the adhesive tape extends partially over the engaged and replenishing paper sheets to join the free replenishing paper end to the free engaged paper end.

20 Claims, 20 Drawing Sheets

(56) References Cited

U.S. PATENT DOCUMENTS

| | | | | |
|---|---|---|---|---|
| 6,228,205 | B1 | 5/2001 | Rhodes | |
| 6,701,992 | B1 | 3/2004 | Pasquale | |
| 6,758,431 | B2 | 7/2004 | Trutschel | |
| 6,808,581 | B2 | 10/2004 | Kuta | |
| 6,830,244 | B2 * | 12/2004 | Komatsu | B65H 5/062 271/10.09 |
| 6,893,521 | B2 * | 5/2005 | Sasaki | B32B 37/185 156/367 |
| 6,966,961 | B2 | 11/2005 | Adami | |
| 7,204,449 | B2 | 4/2007 | Eikmeier | |
| 7,500,634 | B2 | 3/2009 | Benvenuti | |
| 7,726,598 | B2 | 6/2010 | Morelli | |
| 7,946,326 | B2 * | 5/2011 | Lee | B65H 3/446 156/367 |
| 7,980,504 | B2 | 7/2011 | Butterworth | |
| 8,002,924 | B2 | 8/2011 | Machamer | |
| 8,794,618 | B2 * | 8/2014 | Kondo | B65H 3/0684 271/157 |
| 9,067,750 | B2 | 6/2015 | Casey | |
| 9,469,494 | B2 | 10/2016 | Cederholm | |
| 9,550,644 | B2 | 1/2017 | Acciari | |
| 9,670,022 | B2 | 6/2017 | Machamer | |
| 10,189,665 | B2 | 1/2019 | Acciari | |
| 10,457,512 | B2 | 10/2019 | Pasquale | |
| 10,899,568 | B2 | 1/2021 | Pasquale | |
| 10,994,959 | B2 * | 5/2021 | Picchi | B65H 19/20 |
| 11,053,090 | B1 * | 7/2021 | Noviello | H04N 1/00039 |
| 11,352,231 | B2 * | 6/2022 | Tsujimoto | B65H 19/1821 |
| 11,385,588 | B2 * | 7/2022 | Nozaki | G03G 15/6585 |
| 2004/0033095 | A1 * | 2/2004 | Saffari | G07F 17/3202 400/120.01 |
| 2004/0256515 | A1 | 12/2004 | Eikmeier | |
| 2005/0079968 | A1 * | 4/2005 | Trovinger | B65H 45/142 493/356 |
| 2005/0173063 | A1 * | 8/2005 | Hiramoto | B32B 38/004 156/324 |
| 2007/0044898 | A1 | 3/2007 | Hikita | |
| 2009/0114757 | A1 | 5/2009 | Petri | |
| 2010/0187348 | A1 | 7/2010 | Sato | |
| 2011/0073234 | A1 * | 3/2011 | Lee | B32B 41/00 156/364 |
| 2011/0248440 | A1 * | 10/2011 | Sugiyama | G03G 15/6552 271/272 |
| 2014/0062001 | A1 * | 3/2014 | Nogami | B65H 3/0684 271/109 |
| 2014/0131504 | A1 | 5/2014 | Ramteke | |
| 2016/0244290 | A1 * | 8/2016 | De Marco | B65H 19/1852 |
| 2016/0257100 | A1 * | 9/2016 | Tachibana | B32B 37/0053 |
| 2017/0021603 | A1 * | 1/2017 | Kikuchi | B32B 37/0053 |
| 2017/0137251 | A1 * | 5/2017 | Sato | B65H 20/12 |
| 2017/0341894 | A1 * | 11/2017 | Muller | B65H 19/107 |
| 2018/0259895 | A1 * | 9/2018 | Shibasaki | G03G 15/6541 |
| 2020/0338877 | A1 * | 10/2020 | Takahashi | B65H 3/66 |
| 2021/0309478 | A1 | 10/2021 | Pasquale | |

FOREIGN PATENT DOCUMENTS

| | | | |
|---|---|---|---|
| GB | 1580727 | A1 | 12/1980 |
| JP | 4880383 | B2 | 1/2008 |
| KR | 20160042758 | A | 4/2016 |
| KR | 101757428 | B1 | 7/2017 |
| WO | 2015111571 | A1 | 7/2015 |
| WO | 2022008106 | A1 | 1/2022 |

OTHER PUBLICATIONS

Productivity Requirements for ContinuousUnwinding and Splicing Winding SeriesPart II, Davis Standard https://davis-standard.com/custom_blog/productivity-requirements-for-continuous-unwinding-and-splicing-winding-series-2/, Oct. 28, 2019.

* cited by examiner

SPLICING APPARATUS AND METHOD FOR A PAPERBOARD PROTECTIVE CORNER MANUFACTURING SYSTEM

TECHNICAL FIELD

The technical field generally relates to splicing apparatuses for webs of material, and more specifically to splicing apparatuses for paper sheets to form paperboard protective corners or other paper-based products.

BACKGROUND

Some paper-based or paperboard-based products, such as protective corners or edge protectors that are used in packaging, are manufactured from paper sheets which are tensioned and moved towards various processing stations. For example, some protective corners are formed on a production line by unrolling multiple rolls of paper, layering multiple unrolled paper sheets on top of each other, gluing the paper sheets together to form a laminated structure, folding the laminated structure—usually by folding the glued sheets over themselves at least once, sometimes around a thicker cardboard core—before bending the folded laminated structure to form the 90-degree angle of the corner, and cutting the corners at the desired length. This entire process is usually performed in a continuously moving production line.

When a paper roll is depleted or close to becoming depleted, the empty roll must be replaced with a fresh new roll. To avoid having to stop the line to change the roll, manufacturing systems may include a paper accumulator positioned downstream from the roll. The accumulator keeps a "buffer" amount of paper sheet to keep the line moving downstream of the accumulator while the rotation of the roll can be stopped upstream of the accumulator.

Unfortunately, changing the rolls is typically done manually. The operator must manually cut the current sheet from the roll, cut the free end of the new roll (to ensure that a straight cut is formed) and secure the free end of the new roll to the rear end of the paper sheet currently on the production line. The operator has a limited amount of time to perform these operations to prevent the line from stopping, and must manipulate a cutting tool in this limited timeframe which may potentially lead to injury.

There is therefore a need for an apparatus or system that would alleviate at least one of the above-identified drawbacks.

SUMMARY

According to one aspect, there is provided a system for use in the manufacturing of paperboard corners. The system comprises a paper sheet processing assembly for manufacturing the paperboard corners from an engaged paper sheet engaged therein; and a splicing apparatus for splicing together the engaged paper sheet with a replenishing paper sheet, the engaged paper sheet being engaged into the paper sheet processing assembly downstream from the splicing apparatus for processing the engaged paper sheet into the paperboard corners. The splicing apparatus comprises an engaged sheet holder for holding the engaged paper sheet; an engaged sheet cutter for cutting the engaged paper sheet to form a free engaged paper end having a substantially straight engaged paper edge extending substantially perpendicular to a longitudinal axis of the engaged paper sheet; a replenishing sheet holder separate from the engaged sheet holder for holding the replenishing paper sheet; a replenishing sheet cutter for cutting the replenishing paper sheet to form a free replenishing paper end having a substantially straight replenishing paper edge extending substantially perpendicular to a longitudinal axis of the replenishing paper sheet; a sheet end alignment device for positioning the free engaged paper end and the free replenishing paper end relative to each other such that the free engaged paper end and the free replenishing paper end are substantially aligned with each other and such that the engaged paper edge extends substantially parallel to the replenishing paper edge; and an adhesive tape applicator distinct from the engaged and replenishing sheet holders for applying an adhesive tape simultaneously to the aligned free engaged and replenishing paper ends such that the adhesive tape extends partially over the engaged paper sheet and partially over the replenishing paper sheet to join the free replenishing paper end to the free engaged paper end.

In at least one embodiment, the engaged sheet holder, the replenishing sheet holder, the engaged sheet cutter, the replenishing sheet cutter, the sheet end alignment device and the adhesive tape applicator are adapted to receive the engaged paper sheet and the replenishing paper sheet having a width of at least about 200 mm.

In at least one embodiment, the system further comprises a paper accumulator located downstream from the splicing apparatus, the engaged paper sheet extending through the paper accumulator between an accumulator inlet and an accumulator outlet, the paper accumulator being configured to allow movement of the engaged paper sheet to be stopped at the accumulator inlet to allow splicing at the splicing apparatus while maintaining the engaged paper sheet in motion at the accumulator outlet to keep feeding the engaged paper sheet downstream of the paper accumulator during splicing.

In at least one embodiment, the system further comprises a paper roll unwinder motor to unroll the engaged paper sheet at a speed of at least about 100 m/min when the splicing apparatus is not activated.

In at least one embodiment, the system further comprises a remaining paper sensor to measure a remaining amount of the engaged paper sheet; and a controller operatively connected to the remaining paper sensor, the controller being configured for receiving a measured remaining engaged paper value from the remaining paper sensor; comparing the measured remaining engaged paper value with a predetermined threshold; and upon determining that the remaining amount of the engaged paper sheet is below the predetermined threshold, activating the splicing apparatus.

In at least one embodiment, the paper sheet is provided on a paper sheet roll, and the remaining paper sensor includes a diameter sensor for measuring a diameter of the paper sheet roll, the controller being configured to determine the remaining amount of the engaged paper sheet based on the measured diameter of the paper sheet roll.

In at least one embodiment, the splicing apparatus is configured to splice together the engaged paper sheet and the replenishing paper sheet with the engaged paper sheet having a first width and the replenishing paper sheet having a second width different from the first width.

In at least one embodiment, the engaged sheet cutter and the replenishing sheet cutter are exposed portions of a same slidable blade.

According to another aspect, there is also provided a splicing apparatus for splicing together an engaged paper sheet with a replenishing paper sheet in a paperboard corner manufacturing system, the engaged paper sheet being engaged into a paper sheet processing assembly downstream from the splicing apparatus for processing the engaged paper sheet into a paper-based product. The apparatus comprises an engaged sheet holder for holding the engaged paper sheet; an engaged sheet cutter for cutting the engaged paper sheet to form a free engaged paper end having a substantially straight engaged paper edge extending substantially perpendicular to a longitudinal axis of the engaged paper sheet; a replenishing sheet holder separate from the engaged sheet holder for holding the replenishing paper sheet; a replenishing sheet cutter for cutting the replenishing paper sheet to form a free replenishing paper end having a substantially straight replenishing paper edge extending substantially perpendicular to a longitudinal axis of the replenishing paper sheet; a sheet end alignment device for positioning the free engaged paper end and the free replenishing paper end relative to each other such that the free engaged paper end and the free replenishing paper end are substantially aligned with each other and such that the engaged paper edge extends substantially parallel to the replenishing paper edge; and an adhesive tape applicator distinct from the engaged and replenishing sheet holders for applying an adhesive tape simultaneously to the aligned free engaged and replenishing paper ends such that the adhesive tape extends partially over the engaged paper sheet and partially over the replenishing paper sheet to join the free replenishing paper end to the free engaged paper end.

In at least one embodiment, the engaged sheet holder, the replenishing sheet holder, the engaged sheet cutter, the replenishing sheet cutter, the sheet end alignment device and the adhesive tape applicator are adapted to receive the engaged paper sheet and the replenishing paper sheet with a width of at least about 200 mm.

In at least one embodiment, the adhesive tape applicator comprises an abutment member positionable on one side of a front end of the free replenishing paper end and the free engaged paper end aligned with each other and a tape receiver for receiving the adhesive tape with an adhesive side thereof towards the free replenishing paper end and the free engaged paper end, the tape receiver and the abutment member being movable towards each other such that the free engaged and replenishing sheet ends are sandwiched between the abutment member and the tape receiver to thereby apply the tape over the free engaged and replenishing sheet ends.

In at least one embodiment, the tape receiver is movable towards the abutment member in a movement direction substantially corresponding to a normal direction of the replenishing and engaged paper sheets at the free replenishing and engaged paper ends.

In at least one embodiment, the adhesive tape applicator is configured to apply the adhesive tape simultaneously along an entire width of the free engaged and replenishing sheet ends.

In at least one embodiment, the sheet end alignment device includes an alignment actuator operatively coupled to the engaged sheet holder for moving the engaged sheet holder towards the replenishing sheet holder.

In at least one embodiment, the engaged sheet cutter and the replenishing sheet cutter are exposed portions of a same slidable blade.

In at least one embodiment, each one of the engaged sheet holder and the replenishing sheet holder includes a pair of jaw members movable towards each other to hold the corresponding sheet member therebetween.

According to another aspect, there is also provided a method for splicing together an engaged paper sheet with a replenishing paper sheet in a paperboard corner manufacturing system, the engaged paper sheet being fed into a paperboard corner manufacturing assembly downstream from the splicing apparatus. The method comprises: holding the replenishing paper sheet using a replenishing sheet holder separate from an engaged sheet holder; cutting the replenishing paper sheet to form a free replenishing paper end having a substantially straight replenishing paper edge extending substantially perpendicular to a longitudinal axis of the replenishing paper sheet; stopping movement of the engaged paper sheet along at least a rear portion of the engaged paper sheet; holding the engaged paper sheet using the engaged sheet holder; cutting the engaged paper sheet to form a free engaged paper end having a substantially straight engaged paper edge extending substantially perpendicular to a longitudinal axis of the engaged paper sheet; moving the engaged and replenishing sheet holders relative to each other to position the free engaged paper end and the free replenishing paper end relative to each other such that the free engaged paper end and the free replenishing paper end are aligned with each other and such that the engaged paper edge extends substantially parallel to the replenishing paper edge; and applying an adhesive tape simultaneously to the aligned free engaged and replenishing paper ends such that the adhesive tape extends partially over the engaged paper sheet and partially over the replenishing paper sheet to join the free replenishing paper end to the free engaged paper end.

In at least one embodiment, when stopping movement of the engaged paper sheet along at least a rear portion of the engaged paper sheet, the engaged paper sheet is still being fed into the paperboard corner manufacturing assembly by emptying a paper accumulator located downstream from the splicing apparatus.

In at least one embodiment, the method further comprises, before stopping movement of the engaged paper sheet: measuring an amount of engaged paper remaining on an engaged paper roll; and upon detection that the measured amount is lower than a predetermined threshold, stopping the movement of the engaged paper sheet along at least the rear portion of the engaged paper sheet.

In at least one embodiment, the engaged paper sheet is provided on an engaged paper roll, and wherein measuring the amount of paper remaining includes measuring a diameter of the engaged paper roll.

DETAILED DESCRIPTION

Figure 1:
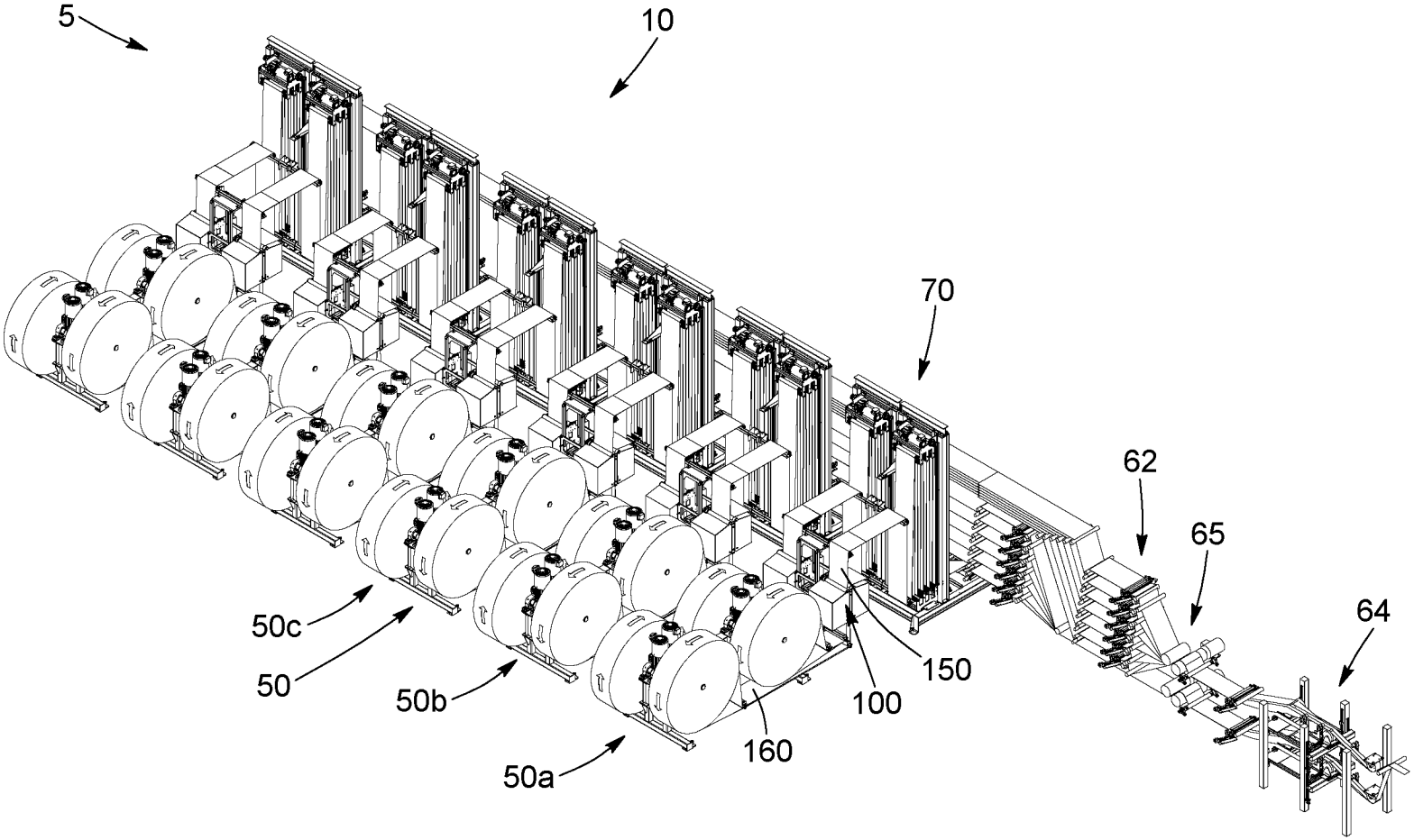
FIG. 1 is a perspective view of a portion of a paperboard protective corner manufacturing system, in accordance with one embodiment.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Referring now to FIG. 1, there is shown a paperboard processing system, in accordance with one embodiment.

In the illustrated embodiment, the paperboard processing system 5 includes a paperboard corner manufacturing system 10 for manufacturing protective paperboard corners (also known as edge protectors) used in packaging.

Alternatively, the paperboard processing system 5 may be configured for manufacturing other types of paperboard-based products made using one or more paper sheets including but not limited to paperboard tubes or the like.

The paperboard corner manufacturing system 10 includes a plurality of processing assemblies 50, 62, 64 for processing one or more paper sheets into paperboard corners.

In the illustrated embodiment, the paperboard corner manufacturing system 10 is configured to receive a plurality of paper sheets and to combine the paper sheets to form the paperboard corners. Specifically, the sheet processing assembly 50 is configured to receive a plurality of paper rolls made of a rolled-up paper sheet. In the illustrated embodiment, the paperboard corners are made of 12 layers of paper sheets, but it is understood that the paperboard corners can be made of a different number of layer(s), such as between 1 to 20 layers, and preferably between 4 to 12 layers, or any suitable number of layers.

The paper sheets are unrolled and moved downstream towards an adhesive application assembly 62, where the paper sheets are layered on top of each other and where an adhesive is applied between the paper sheets and the paper sheets are guided towards each other and combined together to form a laminated multilayered structure. The paperboard corner manufacturing system 10 further includes a folding assembly 64 located downstream from the adhesive application assembly 62 for folding the laminated multilayered structure to provide a desired configuration to the paperboard corners. In one embodiment, the paperboard corner manufacturing system 10 further includes a tension control assembly 65 located upstream of the folding assembly 64 for modulating the tension in the laminated structure prior to being folded by the folding assembly 64. In one embodiment, additional adhesive is also applied to the laminated structure upstream of the folding assembly 64. The paperboard corner manufacturing system 10 may further include a cutting assembly, not shown, located downstream from the folding assembly 64 to cut the paperboard corners at a desired length.

In the illustrated embodiment, the sheet processing assembly 50 includes a plurality of sheet processing assemblies 50*a*, 50*b*, 50*c* that are each configured for receiving a corresponding paper roll and to unroll the paper sheet from the paper roll.

During operation of the paperboard corner manufacturing system 10, the sheet is unrolled from the paper roll and engaged in the paperboard corner manufacturing system 10 downstream of the sheet processing assembly 50, and moved in an downstream direction through the paperboard corner manufacturing system 10 to manufacture the paperboard corners.

In some embodiment, during at least portions of the paperboard manufacturing process, the sheet is unrolled at a speed of at least 50 m/min, and preferably of at least 100 m/min. In some embodiments, the sheet could be unrolled at a speed of up to 200 m/min.

It will be understood that the paper roll is finite, i.e. that the paper roll contains a certain length of the paper sheet. At some point during operation of the paperboard corner manufacturing system 10, the paper sheet currently engaged in the paperboard corner manufacturing system 10, or "engaged" paper sheet, may become unrolled from the paper roll such that no paper sheet is left on the paper roll or such that an amount of the engaged paper sheet left on the paper roll is less than a predetermined minimum amount.

In this case, it is desirable that the paper sheet be replaced with a new or "replenishing" paper sheet, which can also be engaged in the paperboard corner manufacturing system 10 downstream of the sheet processing assembly 50 to allow the paperboard corner manufacturing system 10 to continue manufacturing paperboard corners once the paper roll has been depleted.

To avoid having to stop the entire paperboard corner manufacturing system 10 to change the paper roll to provide the replenishing paper sheet, it may be desirable to be able to join or "splice" the engaged paper sheet currently being processed in the paperboard corner manufacturing system 10 with the replenishing paper sheet. Specifically, splicing the engaged paper sheet and the replenishing paper sheet together includes securing a front end of the replenishing paper sheet to a rear end of the engaged paper sheet such that the replenishing paper sheet forms an extension of the engaged paper sheet, thereby allowing the paperboard corner manufacturing system 10 to continue without interruption.

For this purpose, the sheet processing assembly 50 includes a splicing apparatus 100 which allows the engaged paper sheet 150 and the replenishing paper sheet 160 to be spliced together. Specifically, the splicing apparatus 100 is configured for splicing the engaged paper sheet 150 and the replenishing paper sheet 160 together when both the engaged paper sheet 150 and the replenishing paper sheet 160 are static. This means that the engaged paper sheet 150 is stopped from moving further downstream when the splicing apparatus 100 is in operation.

In the illustrated embodiment, the paperboard corner manufacturing system 10 further includes a paper accumulator 70 located downstream from the splicing apparatus 100, which allows the rear end of the engaged paper sheet 150 to be stopped in order to be spliced with the replenishing paper sheet 160 while the rest of the engaged paper sheet 150 remains in motion in the paperboard corner manufacturing system 10 to continue the manufacturing of paperboard corners.

Figure 2:
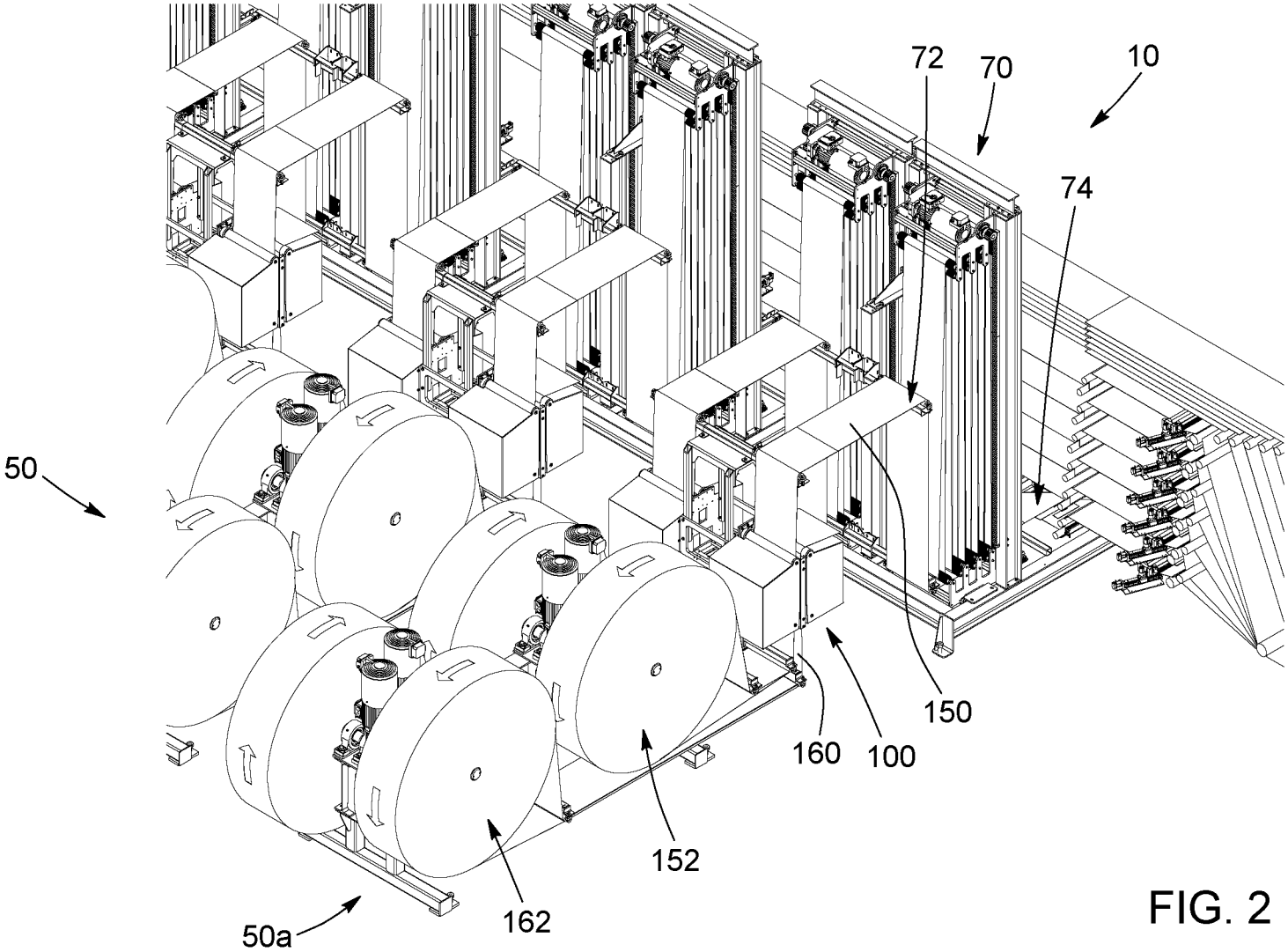
FIG. 2 is a perspective view of an enlarged portion of the portion of the paperboard protective corner manufacturing system illustrated in FIG. 1.

As shown in FIG. 2, more specifically, the engaged paper sheet 150 extends through the paper accumulator 70 between an accumulator inlet 72 and an accumulator outlet 74. The paper accumulator 70 is configured to allow movement of the engaged paper sheet 150 to be stopped at the accumulator inlet 72 to allow splicing at the splicing apparatus 100 upstream from the paper accumulator 70 while maintaining the engaged paper sheet 150 in motion at the accumulator outlet 74 to keep feeding the engaged paper sheet 150 downstream of the paper accumulator 70 during splicing. Paper accumulators are known in the art and the inner workings of the paper accumulator 70 are beyond the scope of the present description. The engaged paper sheet 150 can be provided by unrolling an engaged sheet roll 152 located upstream of the splicing apparatus 100, which is continuously in rotation while in function. The replenishing paper sheet 160 is provided in a replenishing sheet roll 162, also located upstream of the splicing apparatus 100. While an extremity of the replenishing paper sheet is engaged in the splicing apparatus 100, the replenishing sheet roll 162 is not involved in rotation (i.e. unroll) before the splicing apparatus has been activated.

Figure 3:
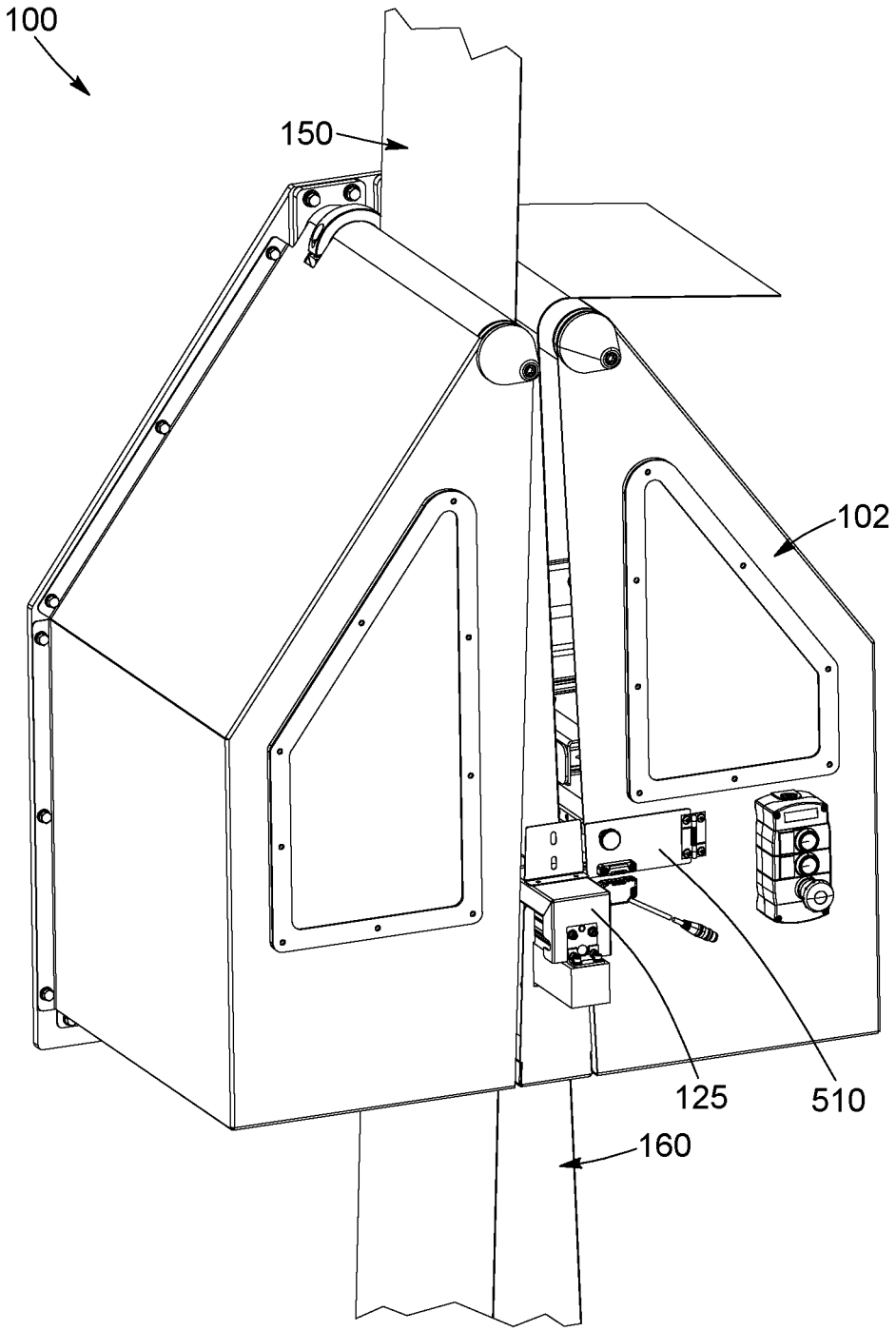
FIG. 3 is a perspective view of a splicing apparatus for the portion of the paperboard protective corner manufacturing system illustrated in FIG. 1, housed inside an apparatus housing.

As shown in FIG. 3, the splicing apparatus 100 further includes a splicing apparatus housing 102 for housing various components of the splicing apparatus 100.

Figure 4:
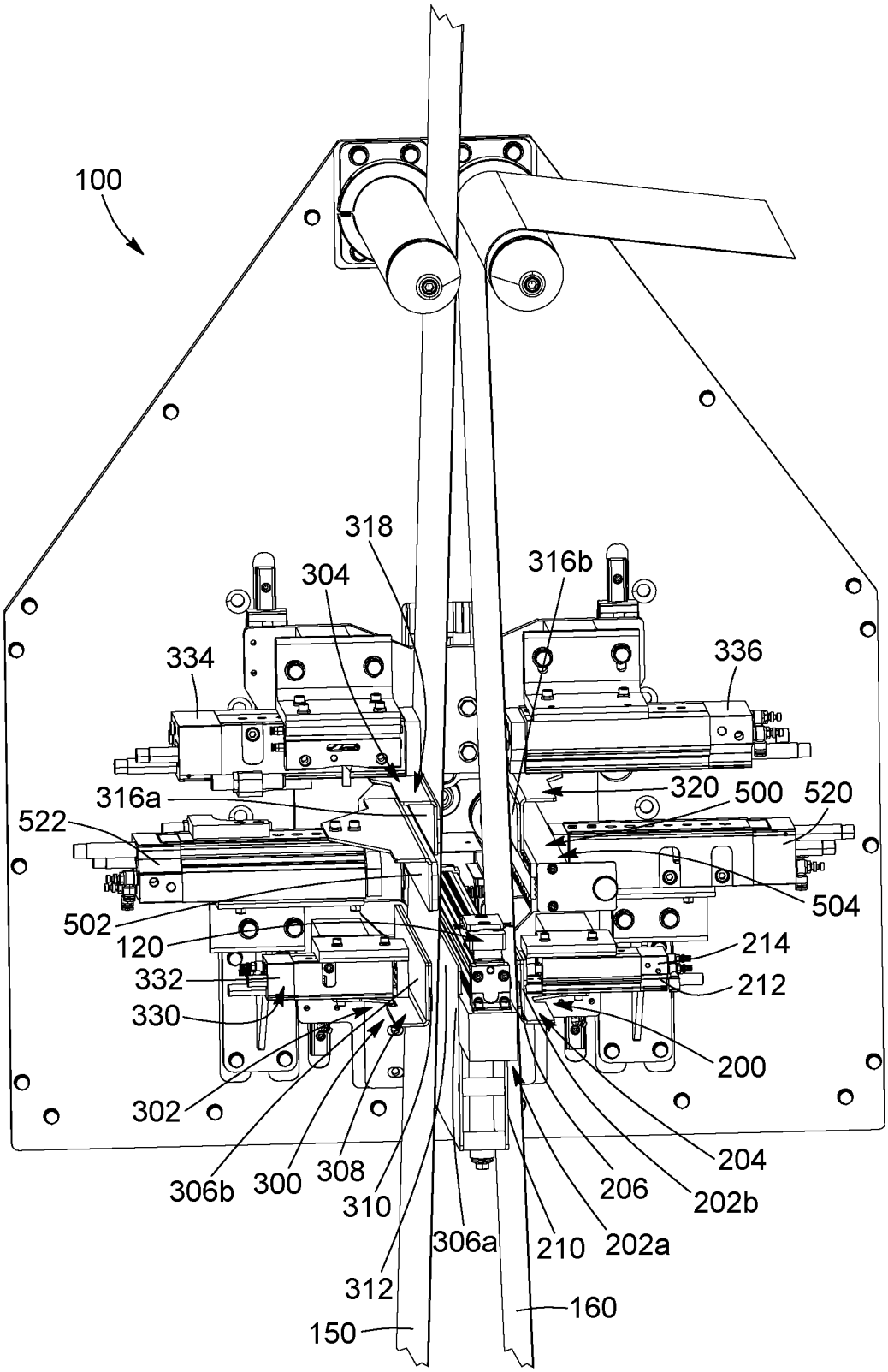
FIG. 4 is a front view of an interior of the splicing apparatus of FIG. 3, without the apparatus housing.

As shown in FIG. 4, the splicing apparatus 100 includes a replenishing sheet holder 200 for holding the replenishing paper sheet 160 and an engaged sheet holder 300 for holding the engaged paper sheet 150. Specifically, in the illustrated embodiment, the engaged sheet holder 300 and the replenishing sheet holder 200 are configured for holding the engaged paper sheet 150 and the replenishing paper sheet 160 when the engaged paper sheet 150 and the replenishing paper sheet 160 are immobile or static. The splicing apparatus 100 further includes an adhesive tape applicator 500 for applying an adhesive tape 550 to thereby splice the engaged paper sheet 150 and the replenishing paper sheet 160 together, as will be more detailed further.

In the illustrated embodiment, the engaged sheet holder 300 is separate from the replenishing sheet holder 200. This configuration allows the engaged sheet holder 300 and the replenishing sheet holder 200 to be moved relative to each other with substantially no restriction. This also allows each one of the engaged sheet holder 300 and the replenishing sheet holder 200 to be serviced, replaced and/or adjusted independently from the other one of the engaged sheet holder 300 and the replenishing sheet holder 200.

In the illustrated embodiment, the replenishing sheet holder 200 includes a pair of inner and outer holding jaws 202*a*, 202*b* that are selectively moveable towards and away from each other. In the illustrated embodiment, each jaw 202*a*, 202*b* is elongated and extends substantially in a widthwise direction of the engaged paper sheet 150, i.e. transversally to the engaged paper sheet 150.

In this embodiment, each jaw 202*a*, 202*b* has a length which is longer than a width of the replenishing paper sheet 160 so as to be able to grasp the replenishing paper sheet 160 along its entire width.

In one embodiment, the engaged paper sheet 150 and the replenishing paper sheet 160 do not have the same width, i.e. the engaged paper sheet 150 may have an engaged paper width and the replenishing paper sheet 160 may have a replenishing paper width which is larger or smaller than the engaged paper width. The splicing apparatus 100 is configured to still be able to splice together the engaged paper sheet 150 and the replenishing paper sheet 160. In this embodiment, each jaw 202*a*, 202*b* would be at least as long as a greatest possible width of paper sheet that would be suitable to be used in the paperboard corner manufacturing system 10.

In some embodiments, the paper sheets can have a width equal to or more than 200 mm, such as about 213 mm. The paper sheets can have larger width, such about 270 mm, about 360 mm, or about 420 mm, or any other standard or custom width known in the industry.

In some embodiments, the paper sheets can have a thickness of 8 to 14 points (pts) (corresponding to 0.2 mm to 0.35 mm), where a point equals 1/1000 of an inch or 0.0254 mm. Alternatively, the paper sheets could have any other suitable thickness.

In the illustrated embodiment, the outer jaw 202*b* includes an L-shaped member 204 having a second vertical wall 206 while the inner jaw 202*a* includes a first vertical wall 210. The first vertical wall 210 is mounted on a first lateral surface of a sliding guide 128, as will be further explained below. The replenishing paper sheet 160 is held between the second vertical wall 206 and the first vertical wall 210 when the replenishing sheet holder is in a closed configuration.

The replenishing sheet holder 200 further includes a jaw actuation assembly 212 operatively coupled to one or both of the holding jaws 202*a*, 202*b*. Specifically, in the illustrated embodiment, the jaw actuation assembly 212 includes a replenishing holder linear actuator 214 connected to the outer holding jaw 202*b*. The replenishing holder linear actuator 214 is mounted so as to extend in a substantially normal direction relative to a plane defined by the replenishing paper sheet 160. In this embodiment, only the outer holding jaw 202*b* is actuated, the inner jaw 202*a* remaining static during operation of the replenishing sheet holder 200. To hold the replenishing paper sheet 160, once the replenishing paper sheet 160 is positioned between the holding jaws 202*a*, 202*b*, the replenishing holder linear actuator 214 is actuated to move the outer holding jaw 202*b* towards the replenishing paper sheet 160 and towards the inner jaw 202*a*, such that the replenishing sheet holder 200 is in the closed configuration.

Alternatively, the jaw actuation assembly 212 could further include another linear actuator coupled to the inner jaw 202*a* and both the holding jaws 202*a*, 202*b* could be moved towards each other during operation of the replenishing sheet holder 200.

The engaged sheet holder 300 includes a lower engaged holder assembly 302 and an upper engaged holder assembly 304 which is spaced upwardly from the lower engaged holder assembly 302. The lower engaged holder assembly 302 is substantially a mirror image of the replenishing sheet holder 200 and includes an outer lower jaw 306*b* comprising an L-shaped member 308 having a first vertical wall 310 and an inner lower jaw 306*a*. In this embodiment, the inner lower jaw 306*a* includes a second vertical wall 312, mounted on a second lateral surface of the sliding guide 128. The engaged paper sheet 150 is held between the first vertical wall 310 and the second vertical wall 312 when the lower engaged holder assembly 302 is in a closed configuration.

The upper engaged holder assembly 304 includes a first upper jaw 316*a* comprising an L-shaped member 318 and a second upper jaw 316*b* also comprising an L-shaped member 320.

Similarly to the replenishing sheet holder 200, the engaged sheet holder 300 also includes a jaw actuation assembly 330. In the illustrated embodiment, the jaw actuation assembly 330 includes a lower linear actuator 332 coupled to the outer lower jaw 306*b*. The jaw actuation assembly 330 further includes a first upper linear actuator 334 coupled to the first upper jaw 316*a* and a second upper linear actuator 336 coupled to the second upper jaw 316*b*. The first and second upper linear actuators 334, 336 and the lower linear actuator 332 are all mounted so as to extend in a substantially normal direction relative to a plane defined by the engaged paper sheet 150.

To hold the engaged paper sheet 150, once the engaged paper sheet 150 is positioned between the holding jaws 306*a*, 306*b*, the lower linear actuator 332 is actuated to move the outer lower jaw 306*b* towards the engaged paper sheet 150 and towards the inner jaw 306*a*, which remains static. The second upper linear actuator 336 is further actuated to move the second upper jaw 316*b* towards the first upper jaw 316*a*. In the illustrated embodiment, the first upper linear actuator 334 is also actuated to move the first upper jaw 316*a* slightly towards the second upper jaw 316*b*. Alternatively, the first upper linear actuator 334 may not be actuated and the first upper jaw 316*a* could remain static.

In one embodiment, the linear actuators include pneumatic actuators. Alternatively, the linear actuators could include hydraulic actuators, rack-and-pinion actuator, a threaded shaft coupled to a rotary motor, or any other suitable actuators. In another embodiment, the jaw actuation assemblies 212, 330 may include any other suitable number of actuators.

Figure 6:
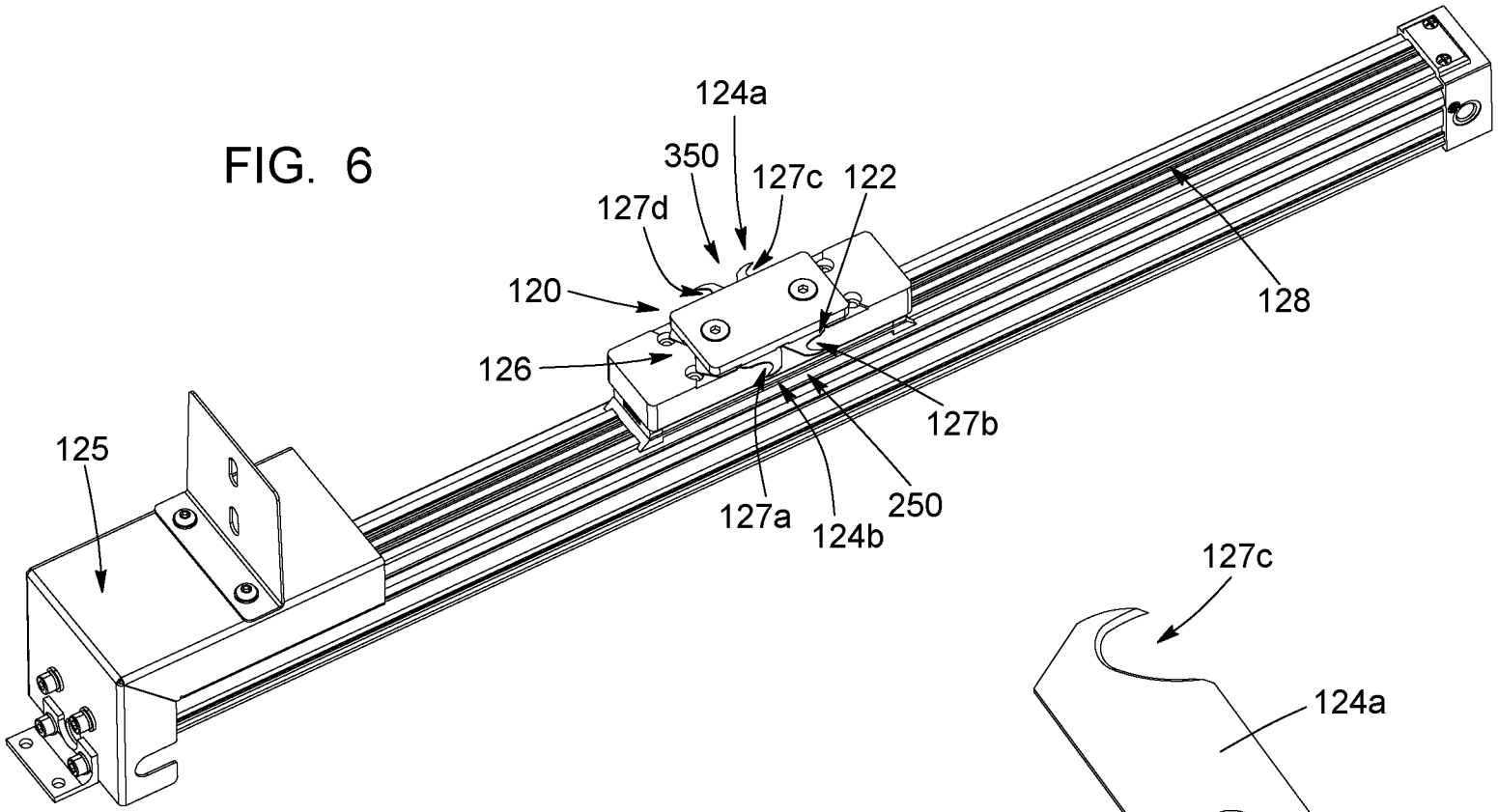
FIG. 6 is a perspective view of a paper sheet cutter mounted on a sliding guide.

As shown in FIG. 6, the splicing apparatus 100 further includes a paper sheet cutter 120, in a first embodiment. The paper sheet cutter 120 comprises two blades 124*a*, 124*b*, both mounted in a mirror configuration on a mobile carrier 126.

The mobile carrier 126 is engaged in the sliding guide 128 such that the paper sheet cutter 120 can be translated in a horizontal direction along the sliding guide 128.

Specifically, the sliding guide 128 is positioned between the engaged paper sheet 150 and the replenishing paper sheet 160, and the two blades 124*a*, 124*b* are positioned above the lower engaged holder assembly 302 and below the upper engaged holder assembly 304.

Figure 6A:
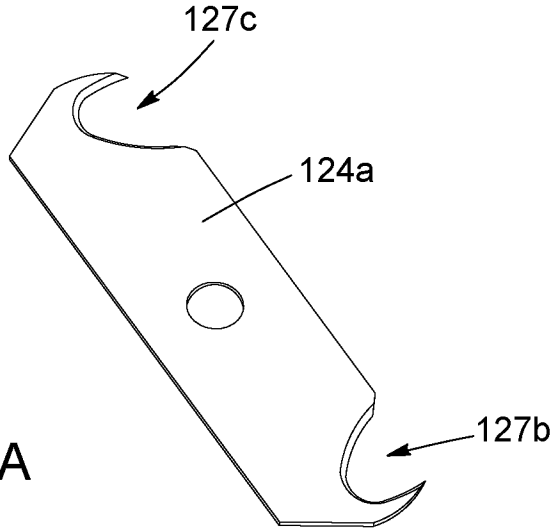
FIG. 6A shows a perspective view of a blade of the paper sheet cutter, in accordance with an embodiment.

In the illustrated embodiment of FIG. 6A, each one of the two blades 124*a* comprises two cutting recesses 127*b*, 127*c* located at each lateral end, such that when the paper sheet cutter 120 is engaged in a translation, the corresponding one of the engaged paper sheet 150 and the replenishing paper sheet 160 to be cut is directed towards the corresponding side of the corresponding cutting recess 127*b*, 127*c* and prevent the paper to tear while being cut.

In the illustrated embodiment, the two blades 124*a*, 124*b* are mounted in a mirror configuration on the mobile carrier 126 and extends substantially perpendicular to a longitudinal axis of the corresponding one of the engaged and replenishing paper sheets 150, 160. The two blades 124*a*, 124*b* have a length greater than a width of the mobile carrier 126, such that each of the cutting recess 127*a*, 127*b*, 127*c*, 127*d* of the two blades 124*a*, 124*b* extends beyond each side of the mobile carrier 126. In such configuration, an engaged sheet cutter 350 for cutting the engaged paper sheet 150 held in the engaged sheet holder 300 is defined by a first cutting recess 127*c* of a first one of the two blades 124*a*, and a first cutting recess 127*d* of the other one of the two blades 124*b*, and a replenishing sheet cutter 250 for cutting the replenishing paper sheet 160 held in the replenishing sheet holder 200 is defined by a second cutting recess 127*b* of the first one of the two blades 124*a*, and a second cutting recess 127*a* of the other one of the two blades 124*b*. The mirror configuration of the two blades 124*a*, 124*b* allows the paper sheet cutter 120 to be able to cut both the engaged paper sheet 150 and the replenishing paper sheet 160 in the two horizontal directions of translation of the mobile carrier 126 engaged in the sliding guide 128.

It is understood that the engaged sheet cutter 350 cannot cut the engaged paper sheet 150 if the engaged paper sheet is not held in the engaged sheet holder 300, and the replenishing sheet cutter 250 cannot cut the replenishing paper sheet 160 if the replenishing paper sheet 160 is not held in the replenishing sheet holder 200. In the illustrated embodiment, both cutters 250, 350 are configured symmetrically to cut the paper in both direction when the paper sheet cutter 120 is horizontally translated along the sliding guide 128.

When the splicing apparatus 100 is not in use, the paper sheet cutter 120 is housed in a blade protective housing 125 extending upwardly from an extremity of the sliding guide 128, and sized to receive the paper sheet cutter 120 in its entirety.

The sliding guide 128 has a length greater than the length of the inner and outer holding jaws 202*a*, 202*b* such that, when hosted in the blade protective housing, the paper sheet cutter 120 does not interfere with the engaged paper sheet 150 and/or the replenishing paper sheet 160. The blade protective housing 125 extends from the extremity of the sliding guide that is facing the operator. The blade protective housing 125 prevents any injuries to the operator while operating the splicing apparatus.

In the illustrated embodiment, the engaged sheet cutter 350 and the replenishing sheet cutter 250 are made of two blades 124*a*, 124*b*, each comprising two cutting recesses. Alternatively, the engaged paper sheet 150 and the replenishing paper sheet 160 could be made of a single blade comprising four cutting recesses. In yet another embodiment, the engaged sheet cutter 350 and the replenishing sheet cutter 250 could be made of four blades, separate and distinct from each other, each of the four blades comprising one cutting recess.

In another embodiment (not shown), the engaged sheet cutter 350 and the replenishing sheet cutter 250 are made of one single piece of circular blade, where the engaged and replenishing sheet cutters correspond to the exposed portions of the same slidable circular blade. Alternatively, the engaged paper sheet 150 and the replenishing paper sheet 160 could be separate and distinct from each other.

In yet another embodiment (not shown), each one of the engaged sheet cutter 350 and the replenishing sheet cutter 250 include an elongated blade member which is pivotable about a first end thereof to cut the corresponding one of the engaged paper sheet 150 and the replenishing paper sheet 160. Each elongated blade member may be coupled to a corresponding pivot actuator which is configured to move the blade member. Alternatively, instead of being pivotable, the elongated blade member could be moved horizontally in a translation movement, for example, or in any other suitable manner. In this embodiment, the engaged sheet cutter 350 and the replenishing sheet cutter 250 are separate and distinct from each other. Alternatively, the engaged paper sheet 150 and the replenishing paper sheet 160 could both be cut using the same cutter. Each elongated blade member extends substantially perpendicular to a longitudinal axis of the corresponding one of the engaged and replenishing paper sheets 150, 160, and both cutters 250, 350 are located substantially in a same horizontal plane.

Alternatively, the engaged sheet cutter 350 and the replenishing sheet cutter 250 could be any other suitable cutter.

Figure 16:
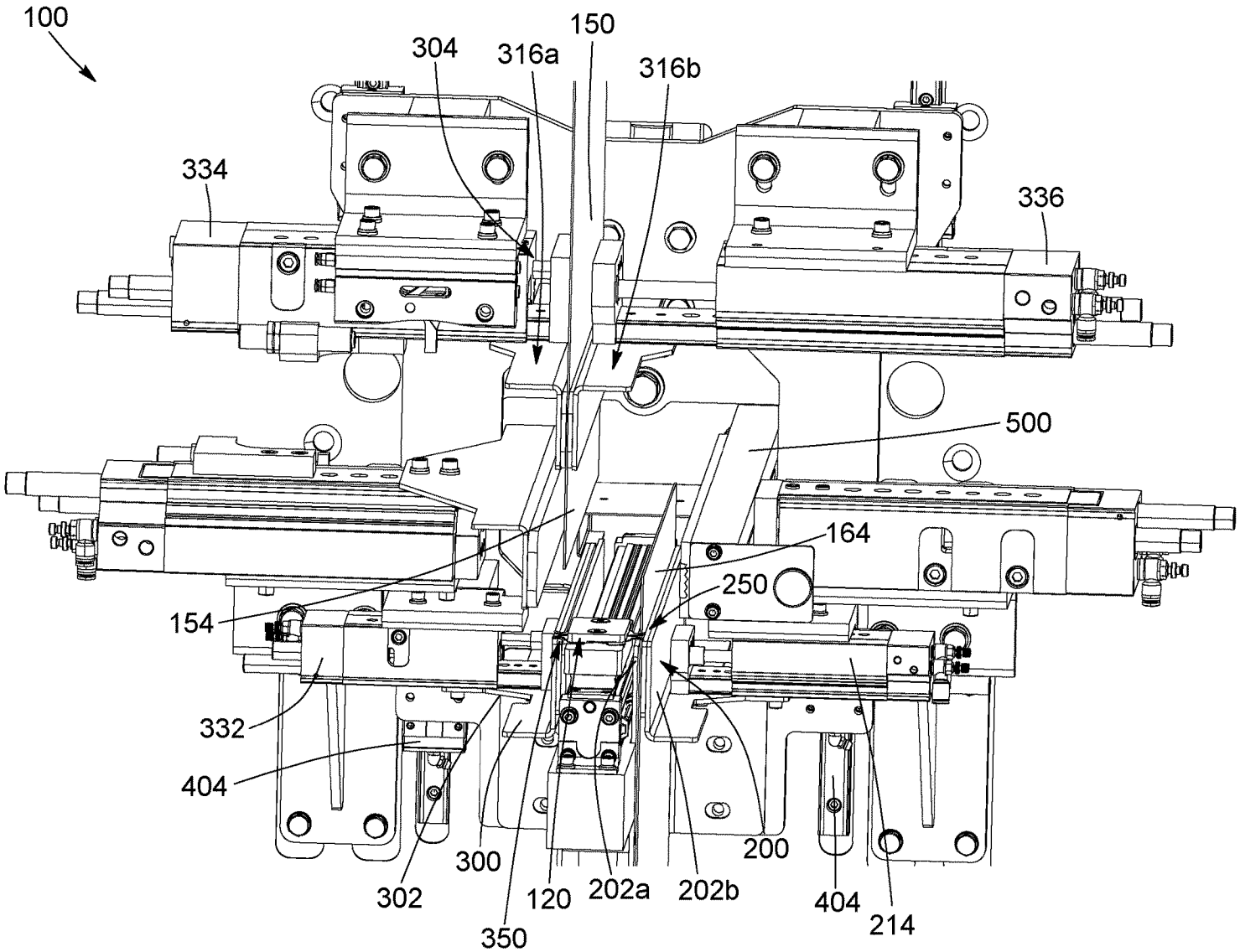
FIG. 16 is an enlarged view of a portion of the splicing apparatus of FIG. 4, with a free engaged paper sheet end and a free replenishing paper sheet end being translated vertically.

Specifically, when cutting the engaged paper sheet 150, the engaged sheet cutter 350 forms a free engaged paper end 154 in the engaged paper sheet 150, the free engaged paper end 154 having a substantially straight engaged paper edge 156 extending substantially perpendicular to the longitudinal axis of the engaged paper sheet 150, as shown in FIG. 16.

Similarly, when cutting the replenishing paper sheet 160, the replenishing sheet cutter 250 forms a free replenishing paper end 164 in the replenishing paper sheet 160, the free replenishing paper end 164 having a substantially straight replenishing paper edge 166 extending substantially perpendicular to the longitudinal axis of the engaged paper sheet 150. Since the replenishing paper sheet 160 is provided from a new paper sheet roll, cutting the replenishing paper sheet 160 results in a free piece of the replenishing paper sheet roll that need to be removed and thrown away.

Figure 7:
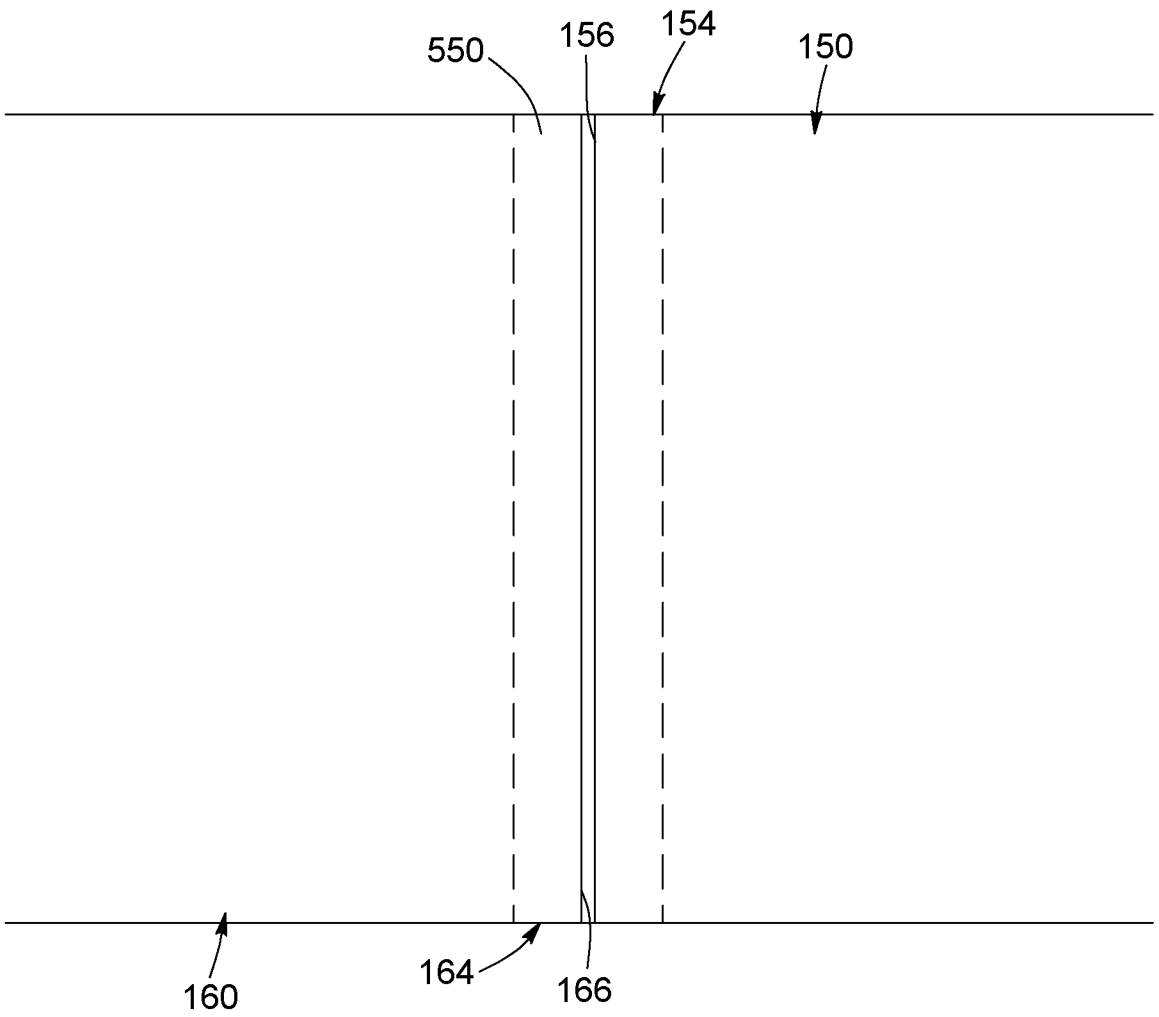
FIG. 7 is a schematic view showing a spliced paper sheet including the replenishing paper sheet and the engaged paper sheet.

The paperboard corner manufacturing system 10 further includes a sheet alignment device 400 for positioning the free engaged paper end 154 and the free replenishing paper end 164 relative to each other such that the free engaged paper end 154 and the free replenishing paper end 164 are substantially aligned, i.e. adjacent, with each other and such that the engaged paper edge 156 extends substantially parallel to and perfectly aligned with the replenishing paper edge 166, without any space between the engaged paper edge 156 and the replenishing paper edge 166, and without any overlap between the engaged paper edge 156 and the replenishing paper edge 166. Although FIG. 7 shows a gap between the engaged paper edge 156 and the replenishing paper edge 166, in reality the gap between the edges of the engaged and replenishing sheets is non-existent or very small, which is advantageous for the manufacture of corner protectors, or cardboard tubes, as it avoids creating a spliced sheet with an excess thickness at the joint.

In the illustrated embodiment, the sheet alignment device 400 is configured for moving the free engaged paper end 154 substantially horizontally towards the free replenishing paper end 164. More specifically, in the illustrated embodiment, the sheet alignment device 400 includes the first and second upper linear actuators 334, 336. When the engaged paper sheet 150 is held between the first and second upper jaws 316*a*, 316*b* and cut, the free engaged paper end 154 and the free replenishing paper end 164 are offset horizontally from each other. By extending the first upper linear actuator 334 and retracting the second upper linear actuator 336, the free engaged paper end 154 is moved towards the free replenishing paper end 164, until the free engaged paper end 154 and the free replenishing paper end 164 are substantially aligned vertically.

In another embodiment, instead of comprising the first and second upper linear actuators 334, 336, the sheet alignment device 400 could include one or more additional actuators distinct from the first and second upper linear actuators 334, 336 for moving the free engaged paper end 154 and the free replenishing paper end 164 towards each other horizontally.

In the illustrated embodiment, the sheet alignment device 400 is also configured for moving simultaneously the free engaged paper end 154 and the free replenishing paper end 164 along the same direction, in this case substantially vertically, to align the free engaged paper end 154 and the free replenishing paper end 164 centered with the middle of the adhesive tape applicator 500. Specifically, the sheet alignment device 400 further includes a vertical movement actuator coupled to the replenishing sheet holder 200 and the engaged sheet holder 300 to move simultaneously the free replenishing paper end 164 and the free engaged paper end 154 upwardly towards the adhesive tape applicator 500.

The splicing apparatus 100 further includes the adhesive tape applicator 500 for applying the adhesive tape 550 simultaneously to the two aligned free engaged and replenishing paper ends 154, 164 to thereby splice the engaged paper sheet 150 and the replenishing paper sheet 160 together. More specifically, the adhesive tape applicator 500 is configured to apply the adhesive tape 550 such that it extends partially over the engaged paper sheet 150 and partially over the replenishing paper sheet 160 to join the free replenishing paper end 164 to the free engaged paper end 154.

In the illustrated embodiment, the adhesive tape applicator 500 includes an abutment member 502 positionable on one side of the free replenishing paper end 164 and the free engaged paper end 154 aligned with each other and a tape receiver 504 for receiving the adhesive tape 550 with an adhesive side of the adhesive tape 550 towards another side of the free replenishing paper end 164 and the free engaged paper end 154. More specifically, the tape receiver 504 and the abutment member 502 are movable towards each other such that the free engaged and replenishing paper ends 154, 164 are sandwiched between the abutment member 502 and the tape receiver 504 to thereby apply the tape 550 over the other side of the free engaged and replenishing paper ends 154, 164. Both the abutment member 502 and the tape receiver 504 have a length which is equal to or greater than the width of the free engaged and replenishing paper ends 154, 164 to ensure that the tape 550 is applied over the entire width of the free engaged and replenishing paper ends 154, 164.

Figure 5A:
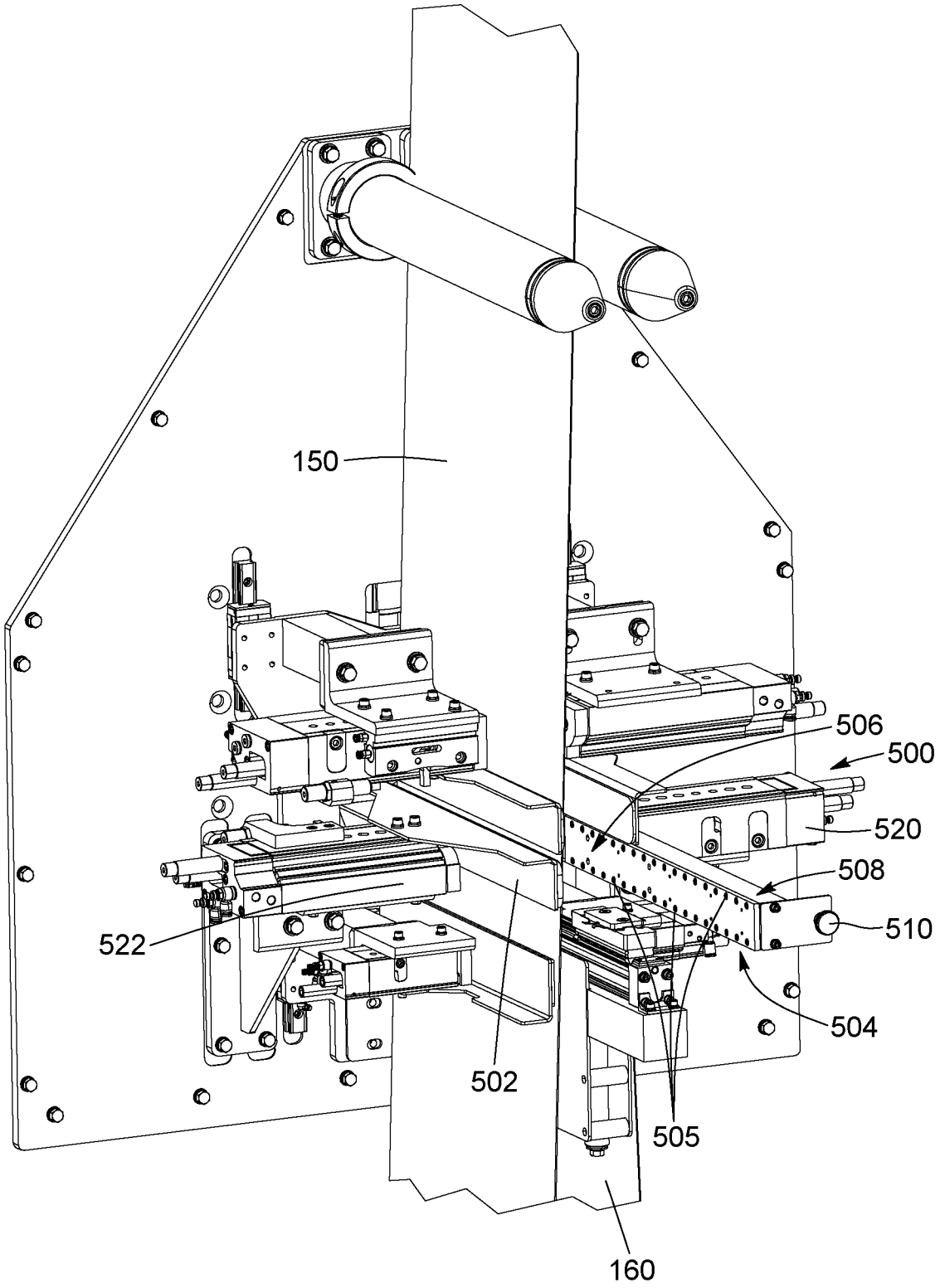
FIG. 5A is a perspective view of the interior of the splicing apparatus of FIG. 4, with a tape receiving member extended to receive an adhesive tape.
Figure 5B:
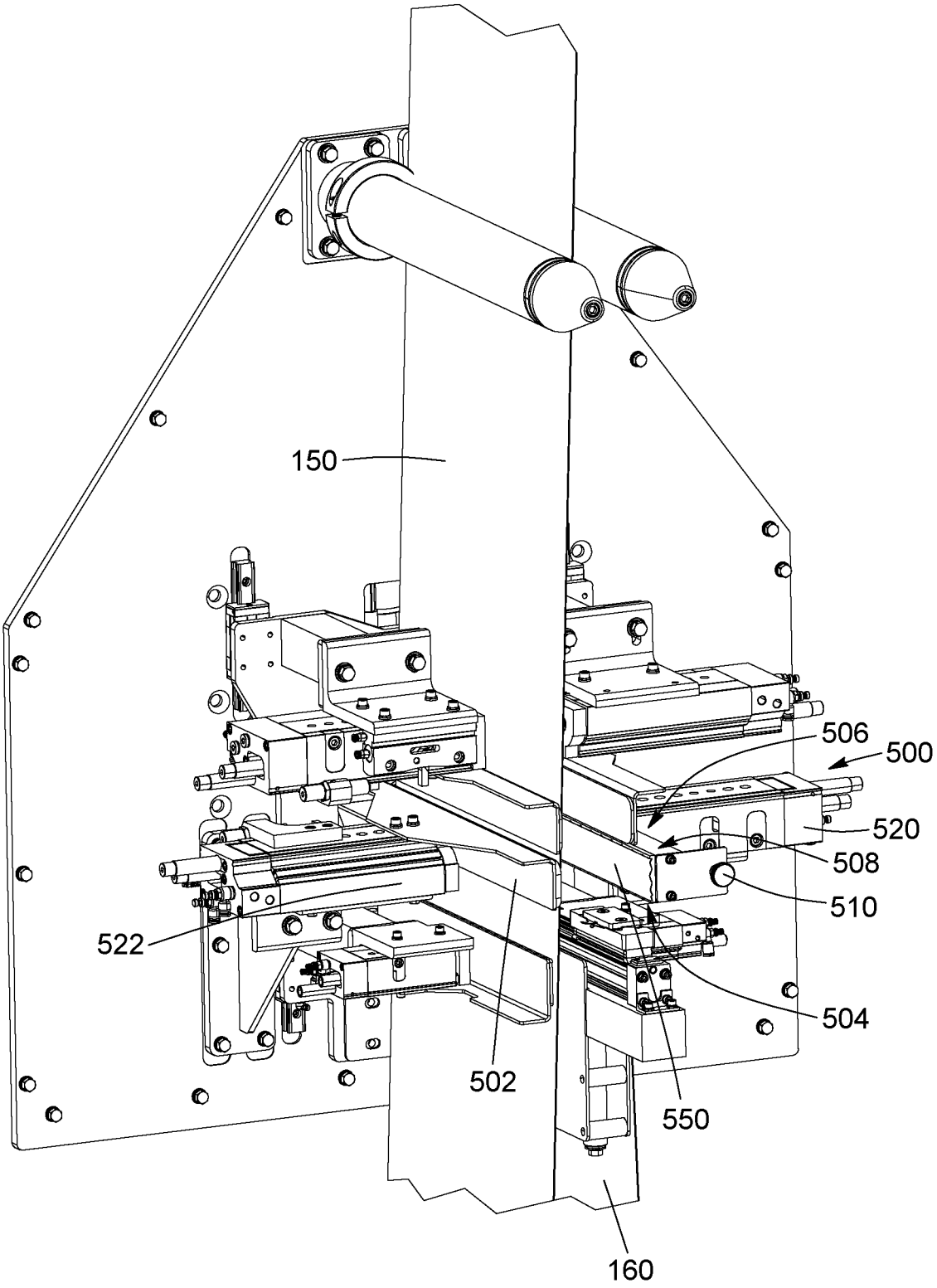
FIG. 5B is a perspective view of the interior of the splicing apparatus of FIG. 4, with the tape receiving member retracted and the adhesive tape positioned on it.

As shown in FIGS. 5A and 5B, the adhesive tape 550, comprising a non-adhesive side opposite to the adhesive side, may be placed manually by an operator on the tape receiver 504. In the illustrated embodiment, the tape receiver 504 further comprises a plurality of vacuum port or suction ports 505 extending along a surface of the tape receiver 504. The plurality of suction ports 505 are connected to a vacuum apparatus (not shown), to maintain the non-adhesive side of the adhesive tape 550 in place on the surface of the tape receiver 504. In the illustrated embodiment, the tape receiver 504 includes a tape holder rail 506 extending substantially horizontally and a tape receiving member 508 slidably mounted to the tape holder rail 506. The tape receiving member 508 includes a handle 510 extending outside the splicing apparatus housing 102, which allows the tape receiving member 508 to be pulled out of the housing 102 in order for the operator to place the adhesive tape 550 on the tape receiving member 508. The tape receiving member 508 can then be slid back into the housing 102 such that the adhesive tape 550 faces an interface between the engaged paper edge 156 and the replenishing paper edge 166.

The adhesive tape applicator 500 further include a tape linear actuator 520 coupled to the tape receiver 504 for moving the tape receiver 504 towards the interface between the engaged paper edge 156 and the replenishing paper edge 166. In the illustrated embodiment, the adhesive tape applicator 500 further includes an abutment actuator 522 coupled to the abutment member 502 for moving the abutment member 502 towards the interface between the engaged paper edge 156 and the replenishing paper edge 166 as well. Both the tape linear actuator 520 and the abutment actuator 522 are positioned to extend in a direction substantially normal to the free engaged and replenishing paper ends 154, 164. It will be appreciated that in this configuration, the tape 550 is applied uniformly and simultaneously along the entire width of the engaged paper sheet 150 and the replenishing paper sheet 160 to ensure an optimal application of the tape 550.

It will also be appreciated that since all actuators in the splicing apparatus 100 are positioned to extend in a direction substantially normal to the paper sheets 150, 160, no effort is exerted on the paper sheets 150, 160 transversally during splicing, which contributes to preventing damage to the paper sheets 150, 160 during splicing.

In the illustrated embodiment, the replenishing sheet holder 200, the engaged sheet holder 300, the adhesive tape applicator 500 and all components of the splicing apparatus 100 are sized to receive paper sheets having a width equal to or more than 200 mm. In particular, the paper sheet cutter 120, which is engaged in the sliding guide 128, can be slide over a length at least corresponding to the largest paper sheet that can be used in the paperboard corner manufacturing system 10. In other words, the paper sheet cutter 120 can be slide in a stroke of at least 200 mm, which is advantageous for the manufacture of corner protectors.

It will also be appreciated that the jaw members 202, 306, 316 of the replenishing sheet holder 200 and the engaged sheet holder 300 are adapted to pinch, maintain and translate paper sheets with a thickness of 8 to 14 pts and a width of at least 200 mm, without tearing the paper sheets, which is also advantageous for the manufacture of corner protectors.

In the above embodiments, all steps of the splicing are automated, except for the cutting and positioning of the adhesive tape 550 on the adhesive tape applicator 500. In another embodiment, the positioning of the adhesive tape 550 on the adhesive tape applicator 500 could also be automated.

In one embodiment, the splicing apparatus 100 further includes a controller operatively connected to the actuators for controlling the actuators. The controller could also be operatively connected to a user interface which could be located on the splicing apparatus 100 or remotely from the splicing apparatus 100 and could be used to activate and/or control the splicing apparatus 100. For example, the controller could allow an operator to manually activate the splicing apparatus 100 to perform a splicing operation. In this embodiment, the paper accumulator 70 is also operatively connected to the controller so as to be activated when the splicing apparatus 100 is activated.

In one embodiment, the splicing apparatus 100 further includes a remaining paper sensor which could be operatively connected to the controller and could measure a remaining amount of the engaged paper sheet 150. Specifically, the controller is configured for receiving a measured remaining engaged paper value from the remaining paper sensor, for comparing the measured remaining engaged paper value with a predetermined threshold, and, upon determining that the remaining amount of the engaged paper sheet 150 is below the predetermined threshold, for activating the splicing apparatus 100.

In one embodiment, the remaining paper sensor includes a diameter sensor for measuring a diameter of the engaged paper roll. The diameter of the engaged paper roll could be monitored substantially constantly or at a predetermined interval during operation of the paperboard corner manufacturing system 10, and measured diameter data could be provided from the diameter sensor to the controller. The controller could be configured to determine the remaining amount of the engaged paper sheet 150 based on the measured diameter of the engaged paper roll. Upon determining that the measured diameter is below a predetermined diameter threshold, the controller activates the splicing apparatus 100.

In some embodiments, the tape 550 and the replenishing paper roll could be pre-emptively prepared and positioned in the splicing apparatus 100. Alternatively, the controller could be configured to provide a signal to an operator when the measured remaining engaged paper value is below the predetermined threshold. The operator could then position the replenishing paper roll and/or the tape 550 as needed. In one embodiment, the controller may be configured to provide the signal to the operator when the measured remaining engaged paper value is below a first threshold such that the operator may position the replenishing paper roll and/or the tape 550 as needed, and then activate the splicing apparatus 100 when the measured remaining engaged paper value is below a second threshold lower than the first threshold. Specifically, the first and second thresholds may be selected to provide the operator sufficient time to position the replenishing paper roll and/or the tape 550 before the splicing apparatus 100 is activated.

In some embodiment, the paperboard corner manufacturing system 10 further includes a tension sensor positioned adjacent the engaged paper sheet 150 for measuring a tension of the engaged paper sheet 150 in the manufacturing system.

The paperboard corner manufacturing system 10 also includes, for each of the engaged sheet roll 152 and replenishing sheet roll 162, a paper roll unwinder including a paper roll axle for receiving the sheet roll 152, 162 containing the paper sheet 150, 160 and an unwinder motor operatively coupled to the paper roll axle for rotating the paper roll axle to unwind the paper sheet from the sheet roll 152, 162.

In addition, the paper accumulator 70 of the paperboard corner manufacturing system 10 further includes an accumulator carriage operatively engaging a carriage track and an accumulator motor operatively coupled to the accumulator carriage for moving the accumulator carriage along the carriage track.

Specifically, the controller is operatively connected to the tension sensor for receiving a measured tension from the tension sensor, the controller being further operatively connected to the unwinder motor for selectively controlling a motor torque of the unwinder motor to adjust the tension in the paper sheet engaged in the sheet processing portion based on the measured tension. In some embodiment, the controller could also be operatively connected to the accumulator motor for selectively controlling a position of the accumulator carriage to adjust the tension in the paper sheet engaged in the sheet processing portion based on the measured tension.

A method for splicing together an engaged paper sheet with a replenishing paper sheet using the splicing apparatus 100 will now be described, in accordance with one embodiment. FIGS. 8 to 19 shows different steps of the method.

Figure 8:
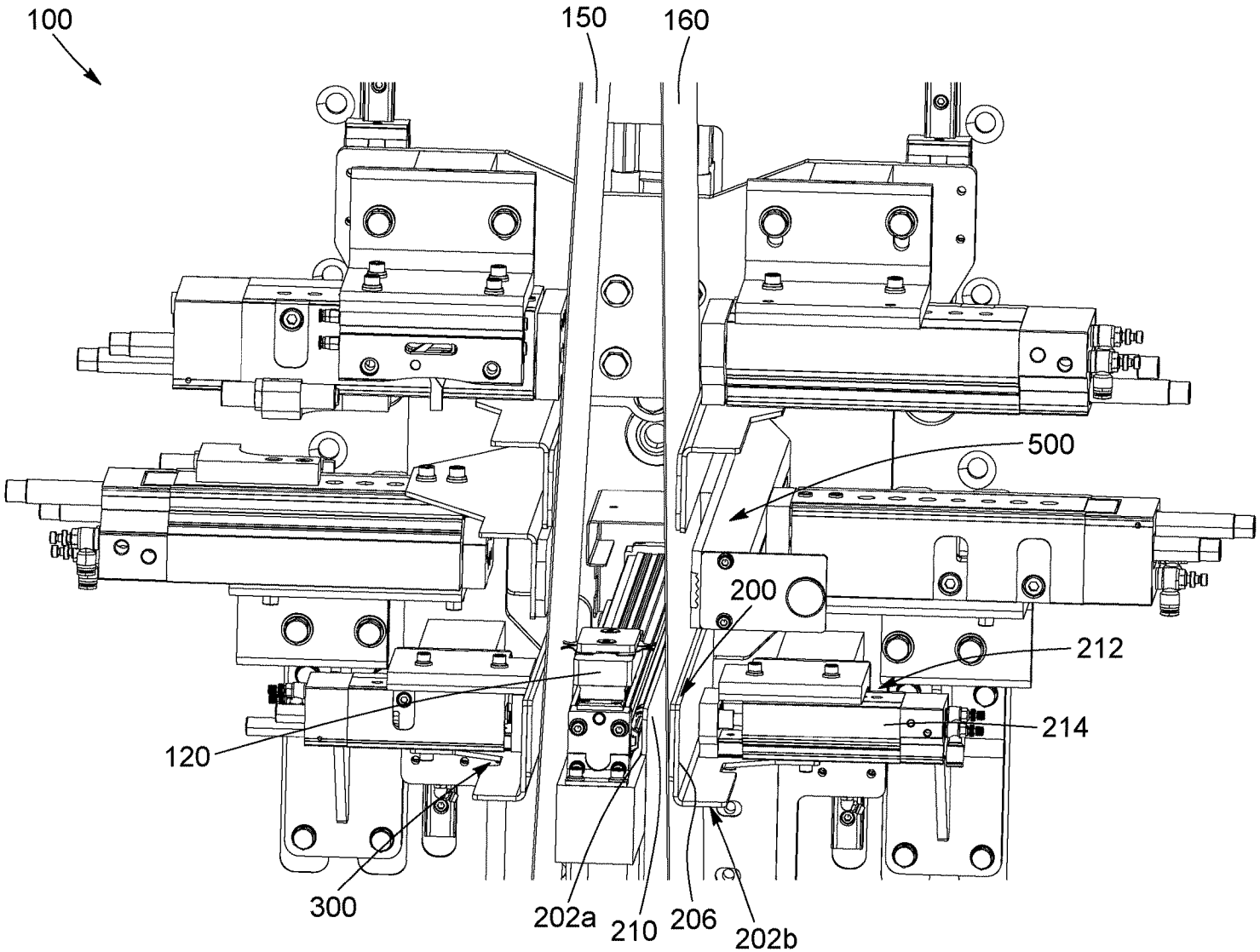
FIG. 8 is an enlarged view of a portion of the splicing apparatus of FIG. 4, with a engaged paper sheet and a replenishing paper sheet, both engaged in the splicing apparatus.

FIG. 8 shows the splicing apparatus 100 in a non-engaged configuration. In this configuration, the engaged sheet holder 300, the replenishing sheet holder 200 and the adhesive tape applicator 500 are unengaged, i.e., none of the engaged paper sheet 150 nor the replenishing paper sheet 160 are held by any holders. The engaged paper sheet 150 is circulating through the splicing apparatus 100 to feed the manufacturing system 10. The replenishing paper sheet 160 has been positioned in the splicing apparatus 100 by the operator.

In an embodiment in which the apparatus 100 includes a remaining paper sensor, remaining paper on the engaged paper roll can be monitored and upon detection that the measured amount is lower than a predetermined first threshold, a splicing sequence is activated. When the splicing sequence is activated, the controller stops the unwinder motor operatively coupled to the paper roll axle, the engaged sheet roll 152 being then stopped from unwinding the engaged paper sheet 150.

The controller further activates the accumulator motor to allow the engaged paper sheet in motion at the accumulator outlet to keep feeding the engaged paper sheet downstream of the paper accumulator during splicing, to avoid stopping of the manufacturing system.

Figure 9:
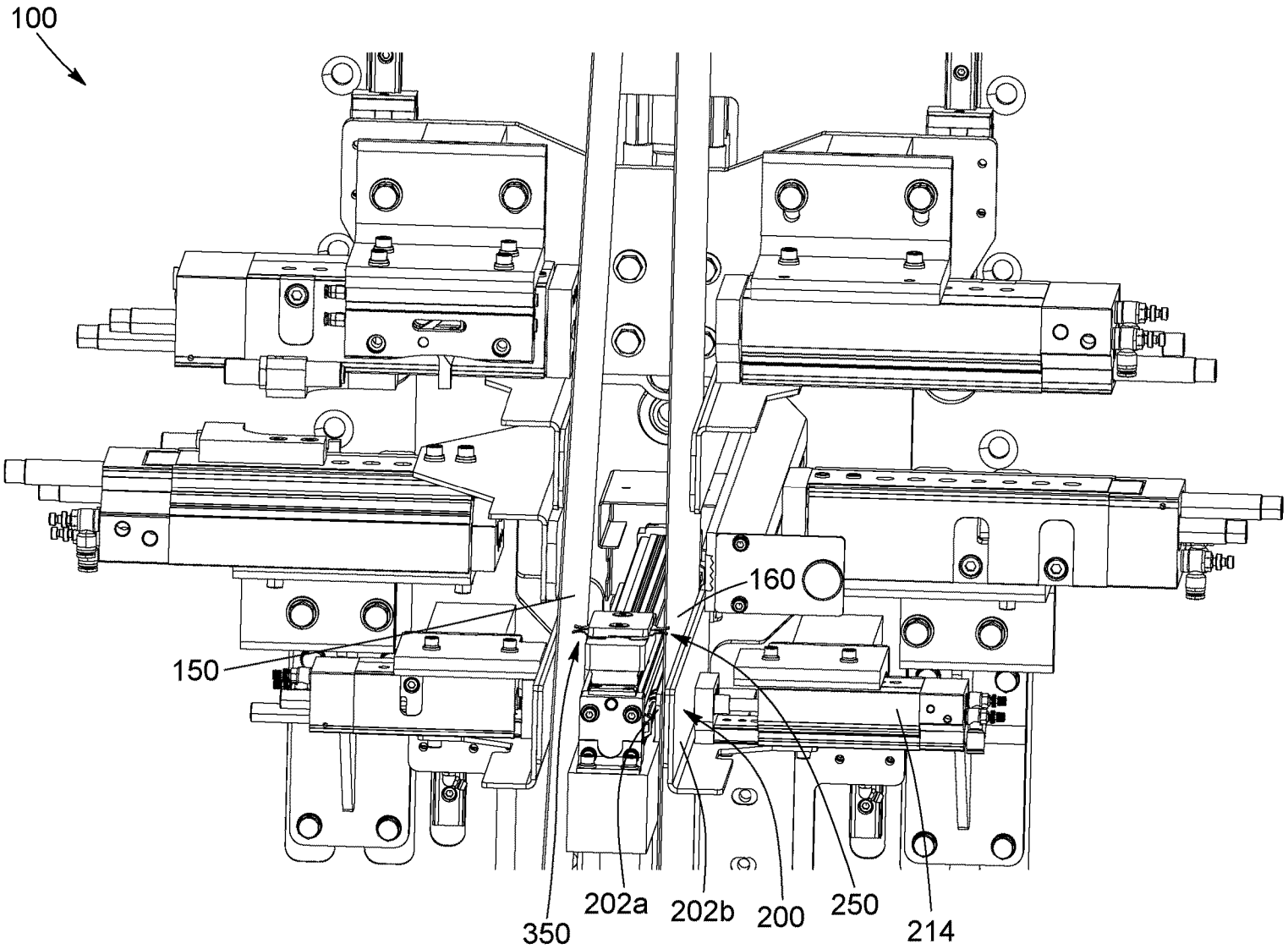
FIG. 9 is an enlarged view of a portion of the splicing apparatus of FIG. 4, with the replenishing paper sheet held by the replenishing sheet holder.
Figure 10:
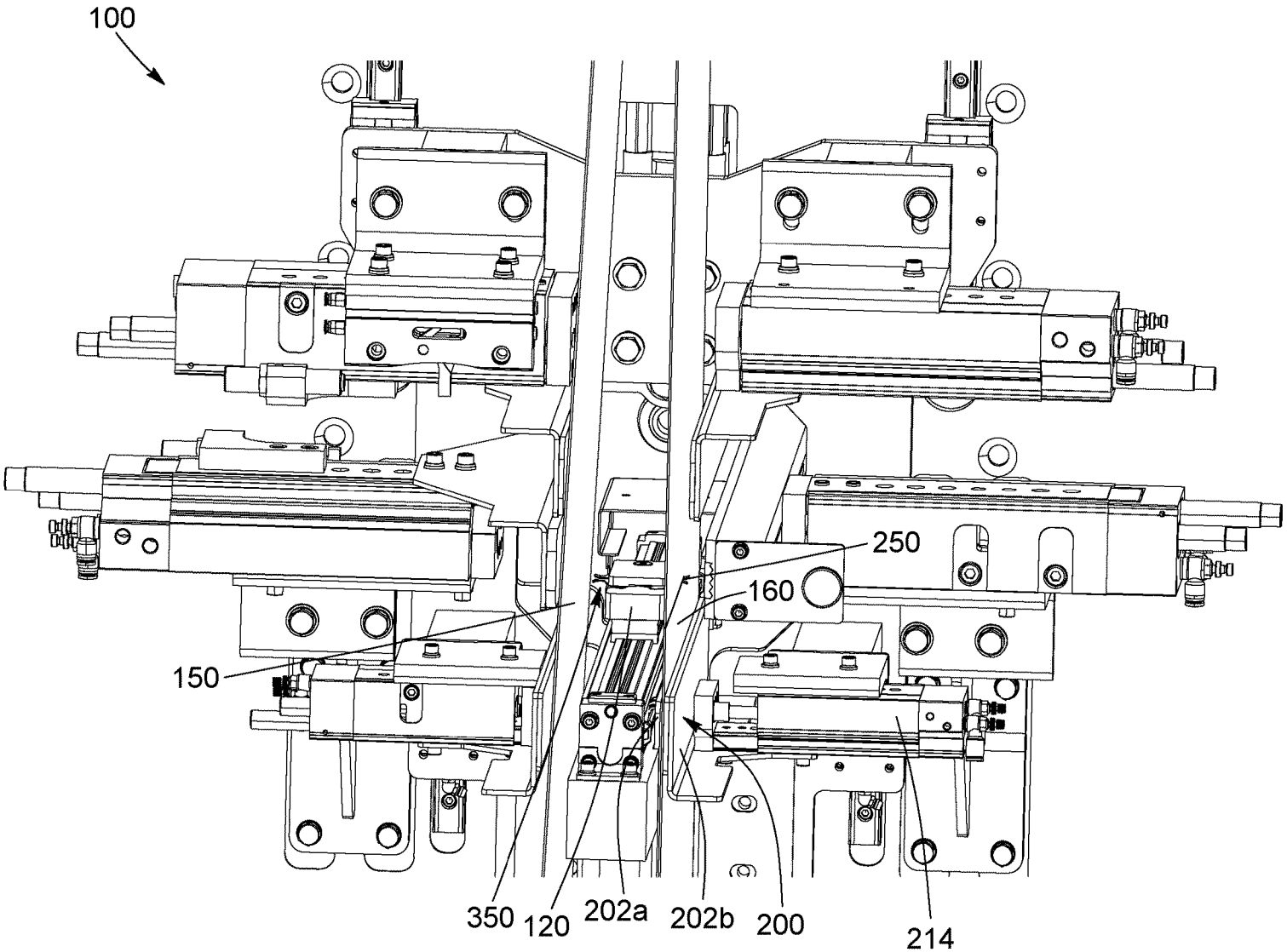
FIG. 10 is an enlarged view of a portion of the splicing apparatus of FIG. 4, showing a replenishing sheet cutter cutting the replenishing paper sheet.
Figure 11:
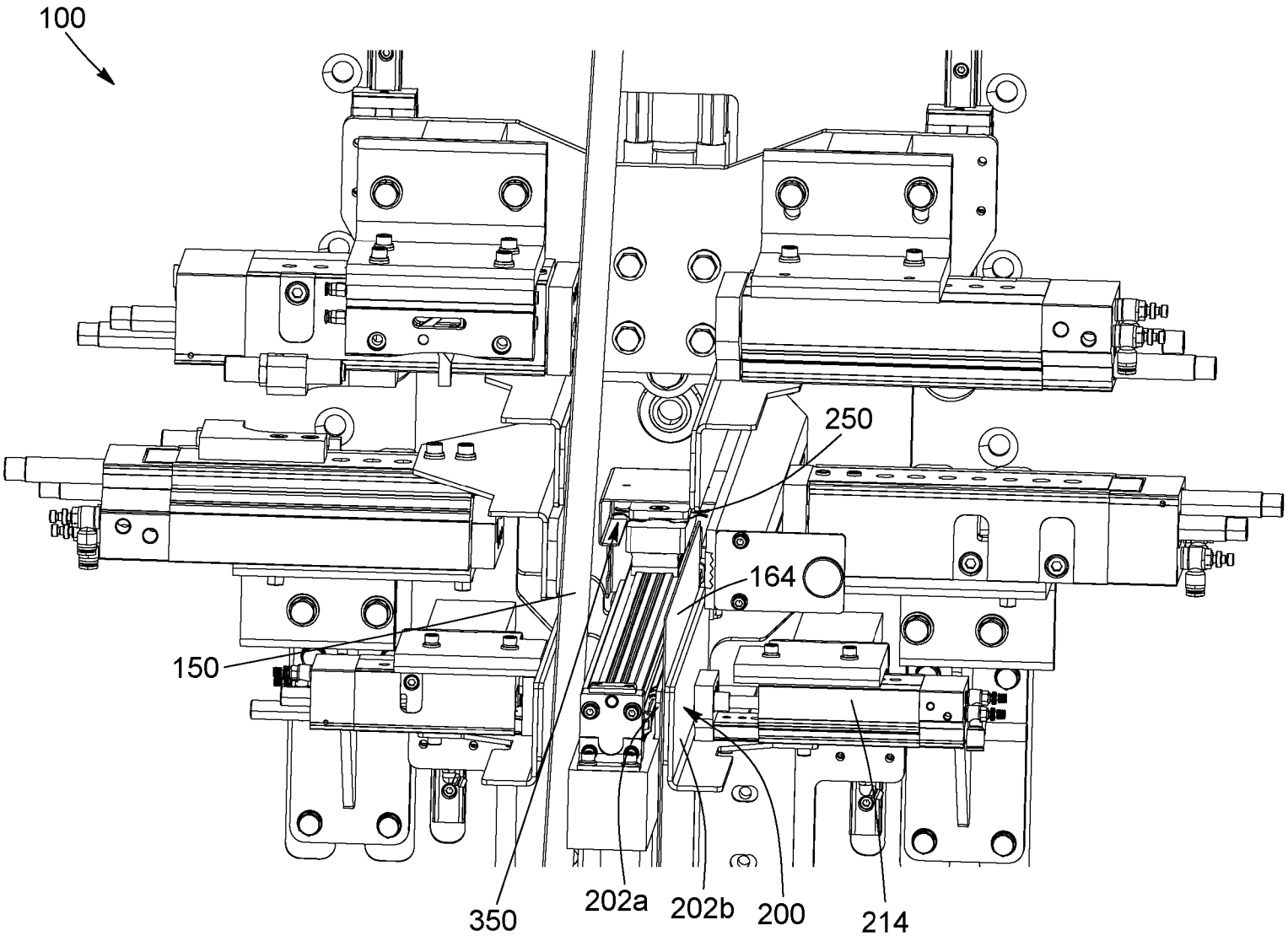
FIG. 11 is an enlarged view of a portion of the splicing apparatus of FIG. 4, with the replenishing paper sheet cut and a free piece of the replenishing paper sheet being removed.
Figure 12:
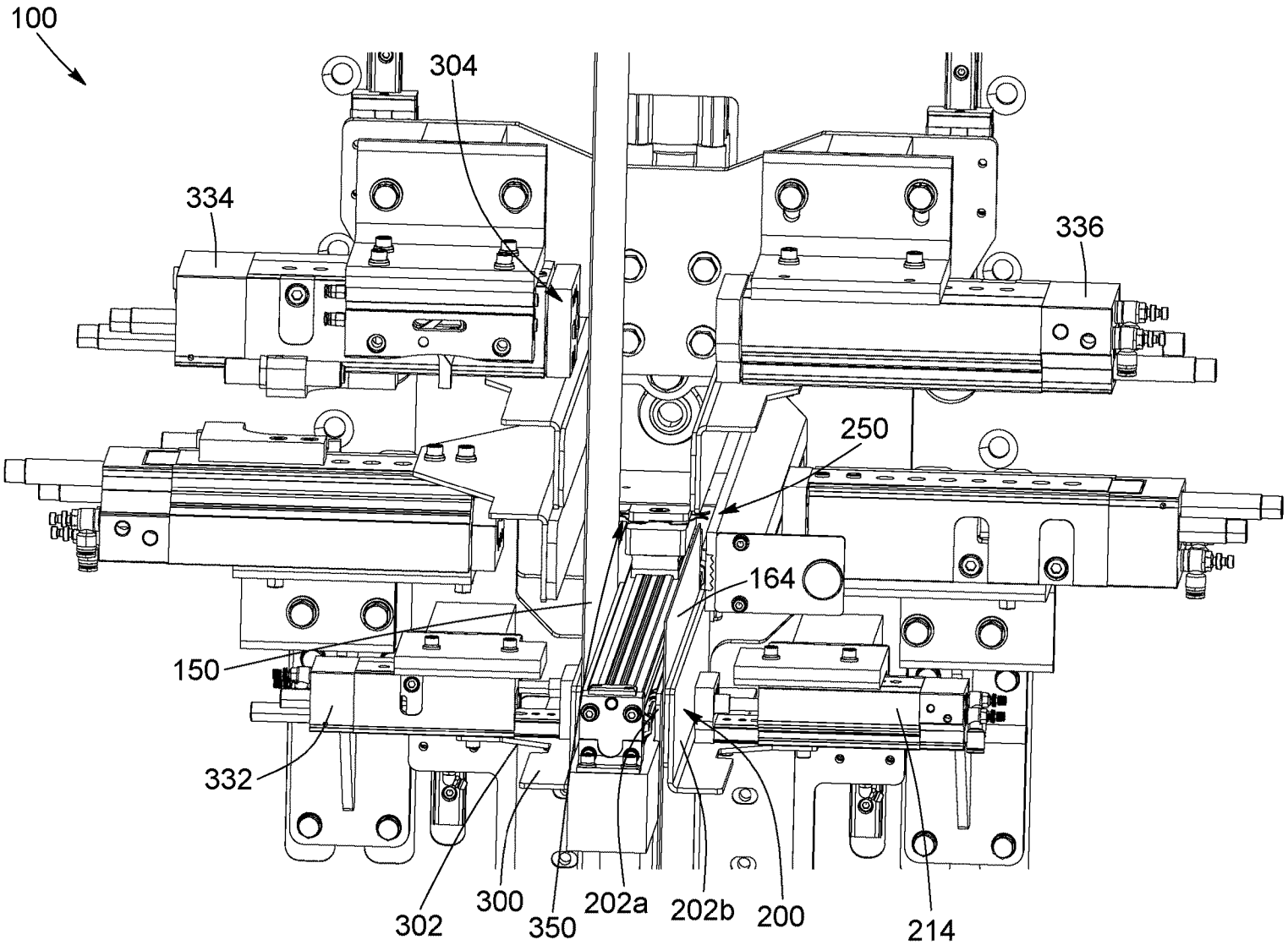
FIG. 12 is an enlarged view of a portion of the splicing apparatus of FIG. 4, with the engaged paper sheet held by a lower engaged holder assembly of an engaged sheet holder.
Figure 13:
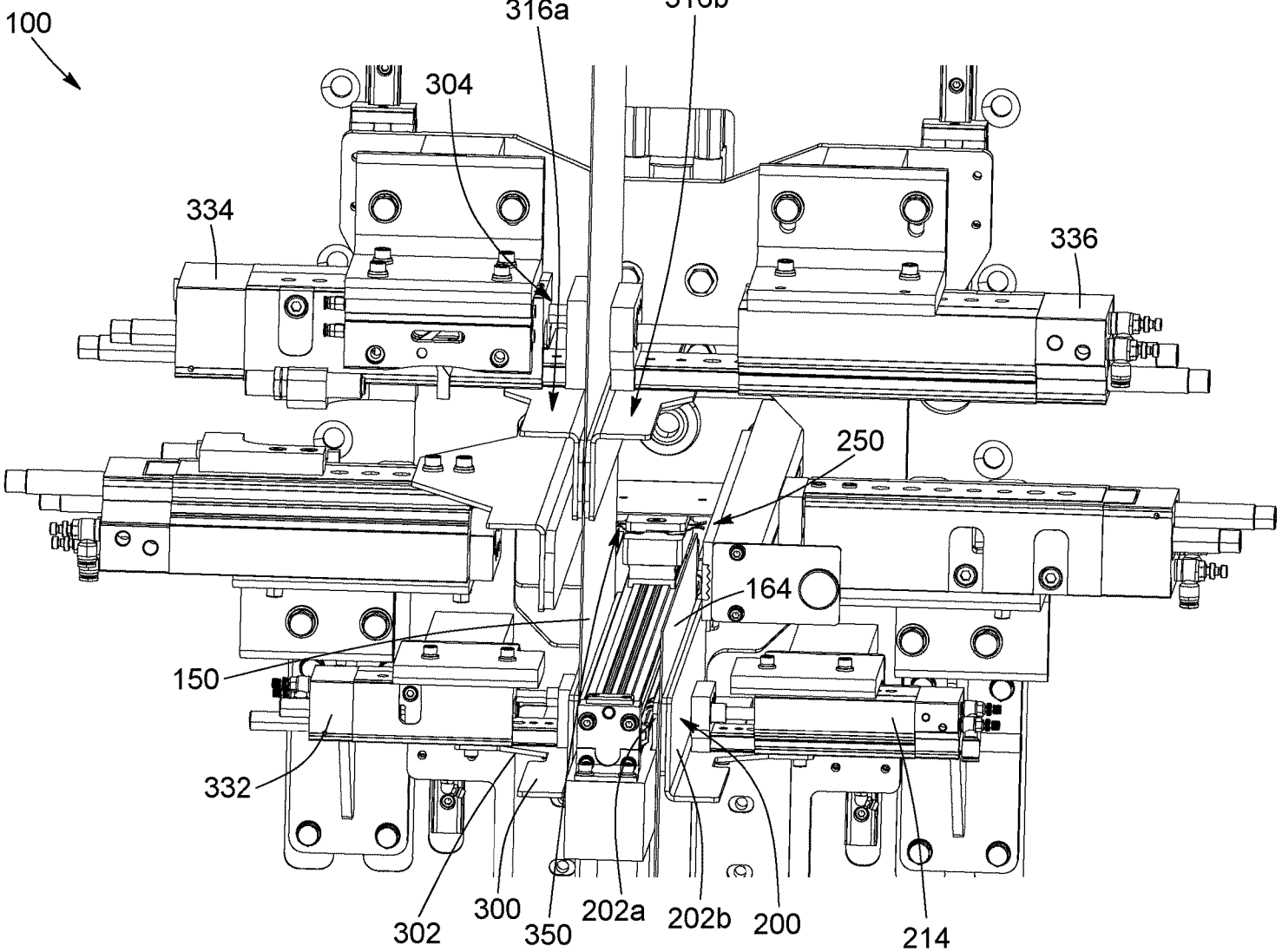
FIG. 13 is an enlarged view of a portion of the splicing apparatus of FIG. 4, with the engaged paper sheet held by the lower engaged holder assembly and by an upper engaged holder assembly of the engaged sheet holder.
Figure 14:
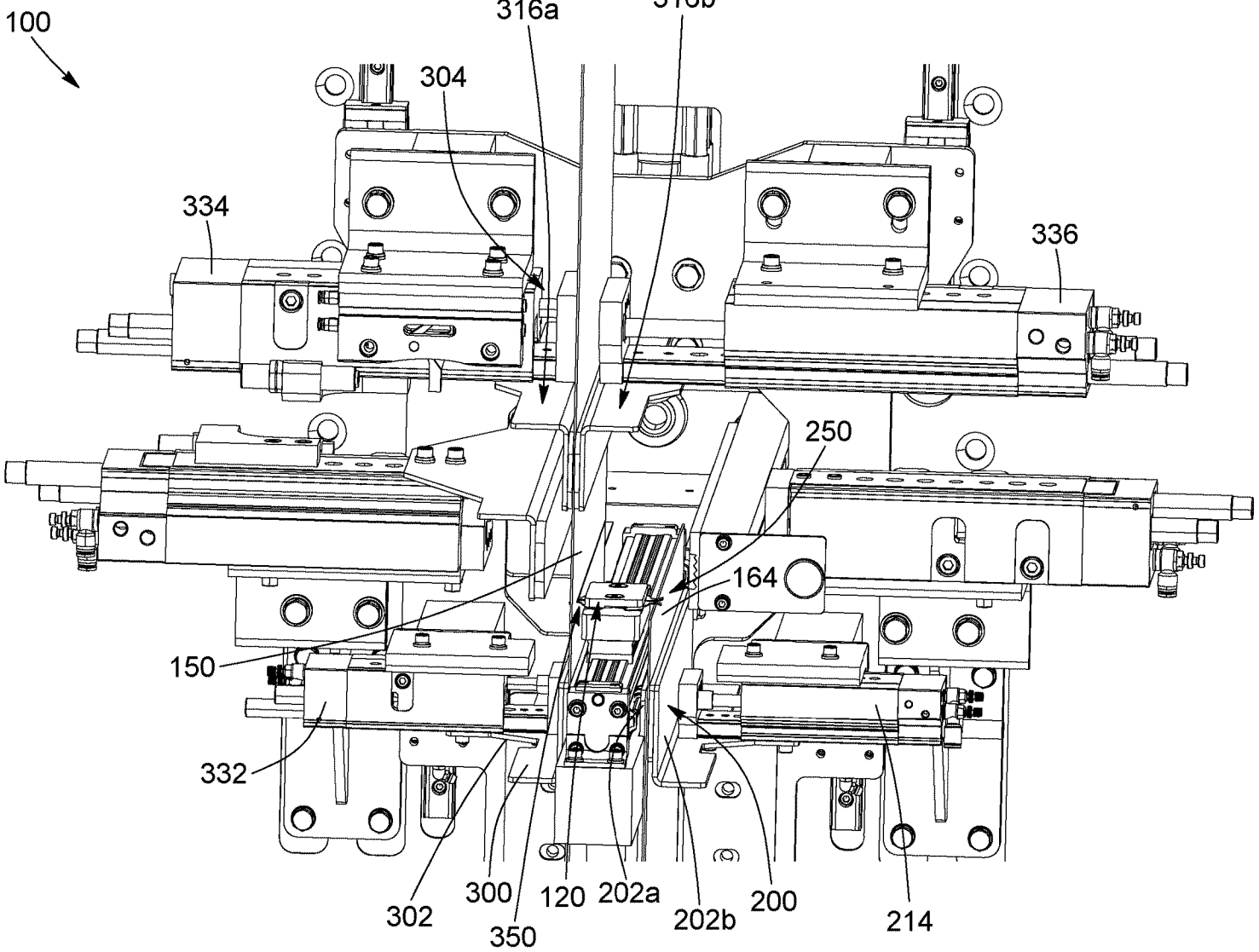
FIG. 14 is an enlarged view of a portion of the splicing apparatus of FIG. 4, showing an engaged sheet cutter cutting the engaged paper sheet.

As shown in FIGS. 9 to 11, the replenishing paper sheet 160 is first held using the replenishing sheet holder 200 (FIG. 9), and cut using the paper sheet cutter 120, and more specifically the replenishing sheet cutter 250 (FIG. 10) to form the free replenishing paper end 164 (FIG. 11). To hold the replenishing paper sheet 160 (i.e., the replenishing sheet holder 200 is in the closed configuration), the outer holding jaw 202*b* is pushed toward the inner holding jaw 202*a* by extending the replenishing holder linear actuator 214. In this step, the replenishing sheet holder 200 and the replenishing sheet cutter 250 may be activated manually by the operator. More specifically, upon detection that the measured amount is lower than the predetermined first threshold, the controller may provide a signal to the operator and upon receiving this signal, the operator may manually activate the replenishing sheet holder 200 and the replenishing sheet cutter 250 to form the free replenishing paper end 164 in the replenishing paper sheet 160. This step can also be automated once the replenishing paper sheet 160 has been engaged in the replenishing sheet holder 200.

In one embodiment, the tape 550 can then be positioned on the adhesive tape applicator 500. Specifically, in the illustrated embodiment, the tape receiving member 508 can be slid outwardly of the housing 102 along the tape holder rail 506 to be accessible to an operator, as shown in FIG. 5A. The operator can then position the adhesive tape 550 on the tape receiving member 508 with the adhesive side of the tape 550 facing away from the tape receiving member 508 and can slide the tape receiving member 508 back into the housing 102, as shown in FIG. 5B.

It is understood that the steps of holding the replenishing paper sheet 160 using the replenishing sheet holder 200, cutting using the replenishing sheet cutter 250 to form the free replenishing paper end 164, and positioning the tape 550 on the adhesive tape applicator 500, as described in FIGS. 9 to 11, can be performed by the operator before activating the splicing sequence, i.e., before the controller stops the unwinder motor operatively coupled to the paper roll axle, and stop the engaged sheet roll 152 from unwinding the engaged paper sheet 150.

In one embodiment, the movement of the engaged paper sheet 150 is then stopped along at least a rear portion of the engaged paper sheet 150. Specifically, movement of the engaged paper sheet 150 may be stopped manually by the operator. Alternatively, movement of the engaged paper sheet 150 may be stopped automatically by the controller when the remaining paper sensor detects that the measured amount is lower than a predetermined second threshold lower than the predetermined first threshold, or upon a detection that the adhesive tape 550 has been positioned on the tape receiving member 508 and that the tape receiving member 508 has been slid back into the housing 102.

In some embodiments, stopping movement of the engaged paper sheet 150 includes stopping only a portion of the engaged paper sheet 150 upstream of the paper accumulator 70 and activating the paper accumulator 70 such that the engaged paper sheet 150 downstream of the paper accumulator 70 remains in movement downstream of the paper accumulator 70.

In an alternative embodiment, instead of holding and cutting the replenishing paper sheet 160, positioning the adhesive tape 550 on the tape receiving member 508 and then subsequently stopping the engaged paper sheet 150 or at least a portion of the engaged paper sheet 150 located at the splicing apparatus, the engaged paper sheet 150 could first be stopped, the replenishing paper sheet 160 can then be held and cut and the adhesive tape 550 may then be placed on the tape receiving member 508. In yet another embodiment, the adhesive tape 550 may be placed on the tape receiving member 508 and the replenishing paper sheet 160 can then be held and cut. The engaged paper sheet 150 could then be stopped as described above.

Figure 15:
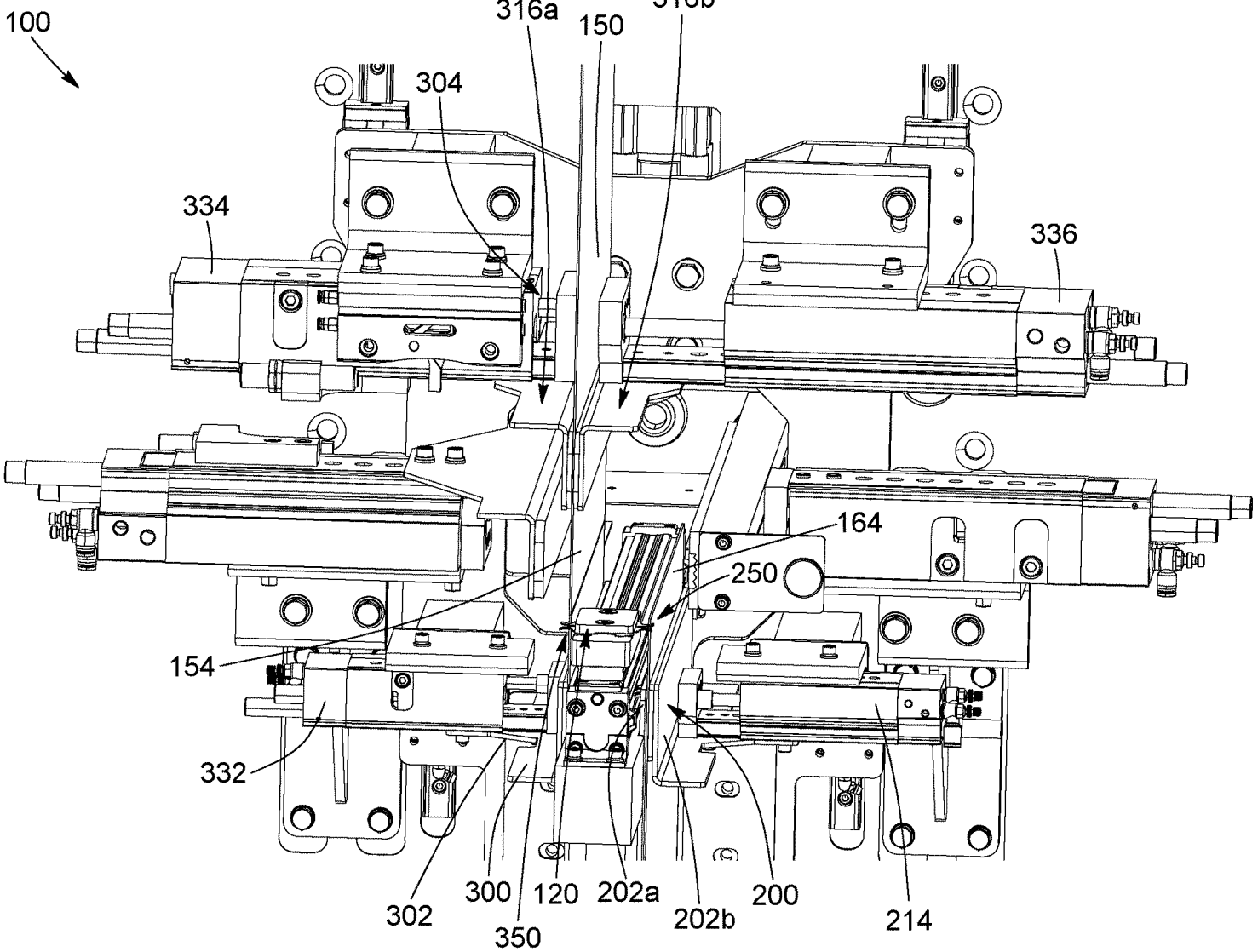
FIG. 15 is an enlarged view of a portion of the splicing apparatus of FIG. 4, with the engaged paper sheet cut.

As shown in FIGS. 12 to 15, the engaged paper sheet 150 is held, using the lower engaged holder assembly 302 of the engaged sheet holder 300 first (FIG. 12), and then using the upper engaged holder assembly 304 of the engaged sheet holder 300 (FIG. 13), as described above, and cut using the engaged sheet cutter 350 (FIG. 14) to form the free engaged paper end 154 (FIG. 15).

It will be understood that the replenishing paper sheet 160 and the engaged paper sheet 150 can be cut simultaneously or successively. In the embodiment shown, the paper sheet cutter 120 is first translated from the font to the back of the splicing apparatus 100 to cut the then-hold replenishing paper sheet 160, and is then translated from the back to the front of the splicing apparatus 100 to cut the then-hold engaged paper sheet 150 (back and forth). However, the paper sheet cutter 120 could cut simultaneously the replenishing paper sheet 160 and the engaged paper sheet 150 if both holes simultaneously, and the cutting step would then require a single translation of the paper sheet cutter 120.

The tape 550 could also be positioned before the replenishing paper sheet 160 is cut or after both paper sheets 150, 160 are cut, or at any other suitable moment.

As shown in FIG. 16, the replenishing paper sheet 160 and the engaged paper sheet 150 are then moved simultaneously upwardly to position the free engaged paper end 154 and the free replenishing paper end 164 substantially aligned with the adhesive tape applicator 500. In the illustrated embodiment, this is performed by actuating the vertical movement actuators 404 coupled to the replenishing sheet holder 200 and the engaged sheet holder 300 to move simultaneously the free replenishing paper end 164 and the free engaged paper end 154 upwardly towards the adhesive tape applicator 500.

Figure 17:
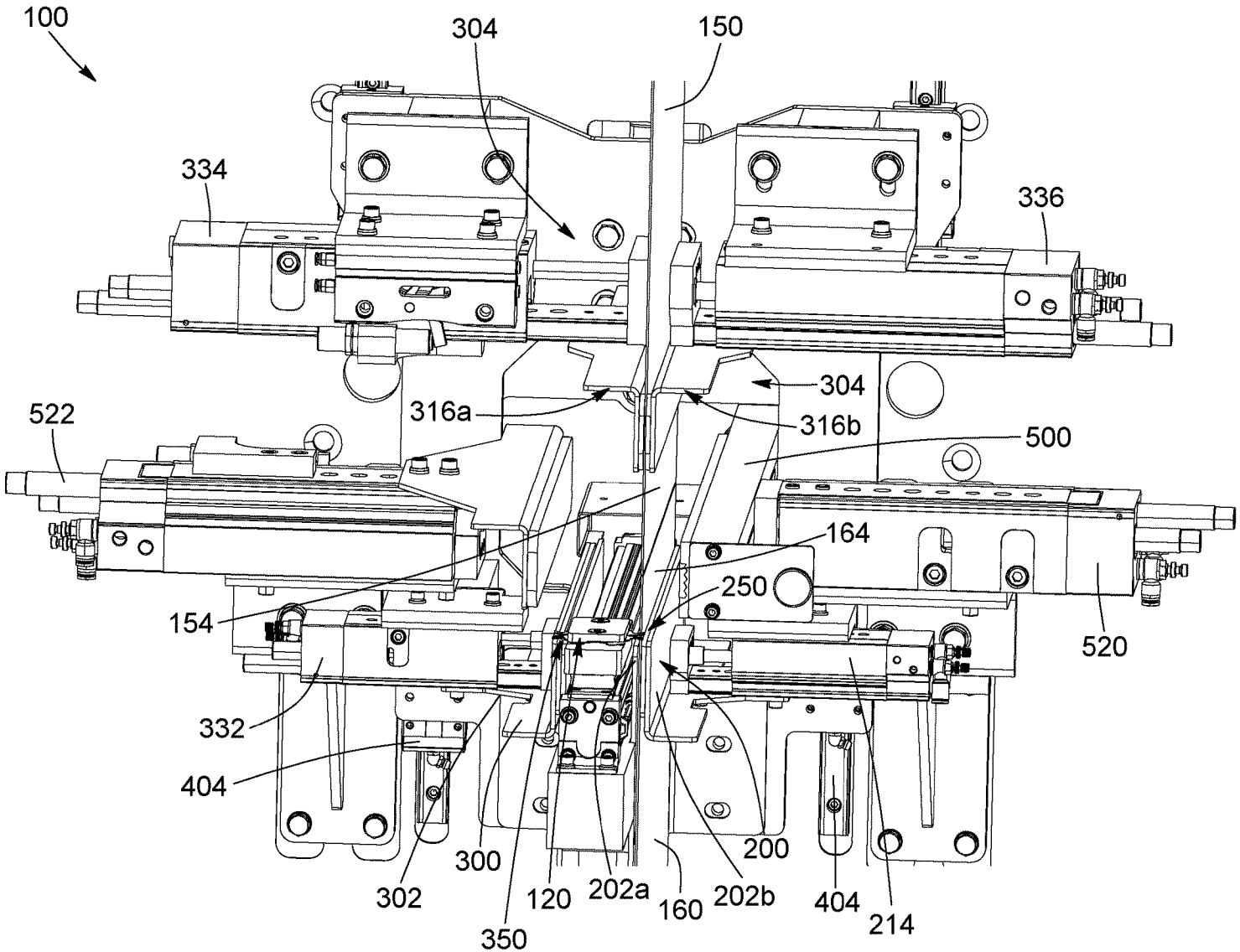
FIG. 17 is an enlarged view of a portion of the splicing apparatus of FIG. 4, with the free engaged paper sheet end and the free replenishing paper sheet end aligned with each other.

As shown in FIG. 17, the upper engaged holder assembly 304 of the engaged sheet holder 300 is then moved laterally to position the free engaged paper end 154 substantially horizontally towards the free replenishing paper end 164 such that the free engaged paper end 154 and the free replenishing paper end 164 are aligned with each other and such that the engaged paper edge 156 extends substantially parallel to the replenishing paper edge 166. In the illustrated embodiment, this is performed by actuating the first and second upper linear actuators 334, 336, and specifically by extending the first upper linear actuator 334 and retracting the second upper linear actuator 336 with the free engaged paper end 154 held between the first and second upper jaws 316*a*, 316*b*.

Figure 18:
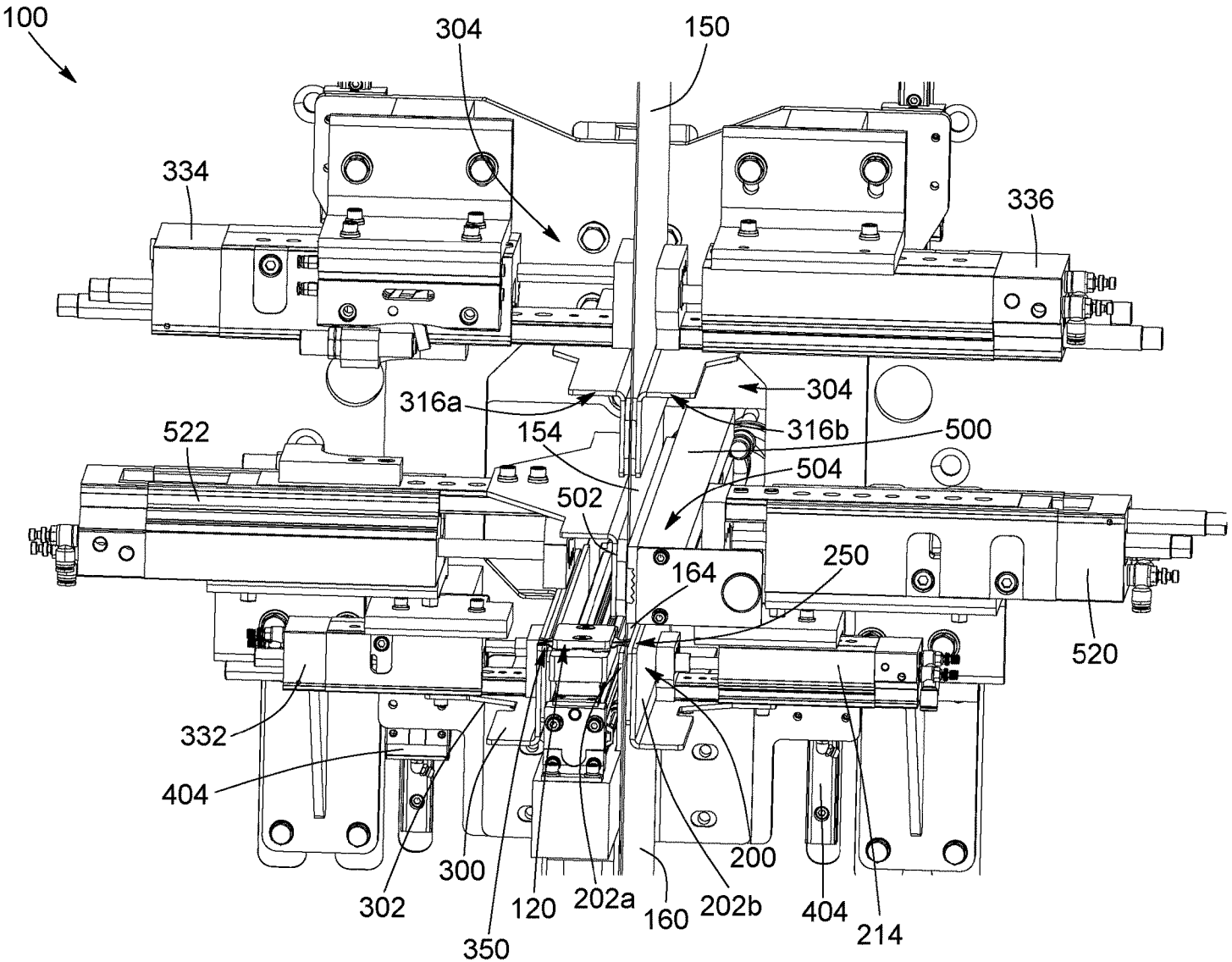
FIG. 18 is an enlarged view of a portion of the splicing apparatus of FIG. 4, with the adhesive tape being applied over the free engaged paper sheet end and the free replenishing paper sheet end.

As shown in FIG. 18, the adhesive tape 550 is then applied simultaneously to the two free engaged and replenishing paper ends 154, 164 such that the adhesive tape 550 extends partially over the engaged paper sheet 150 and partially over the replenishing paper sheet 160 to join the free replenishing paper end 164 to the free engaged paper end 154. Specifically, in the embodiment shown, the abutment actuator 522 can be extended to push the abutment member 502 towards the tape receiver 504 and then press the tape 550 along the interface between the free replenishing paper end 164 to the free engaged paper end 154 to thereby join together or splice the replenishing paper sheet 160 to the engaged paper sheet 150.

Figure 19:
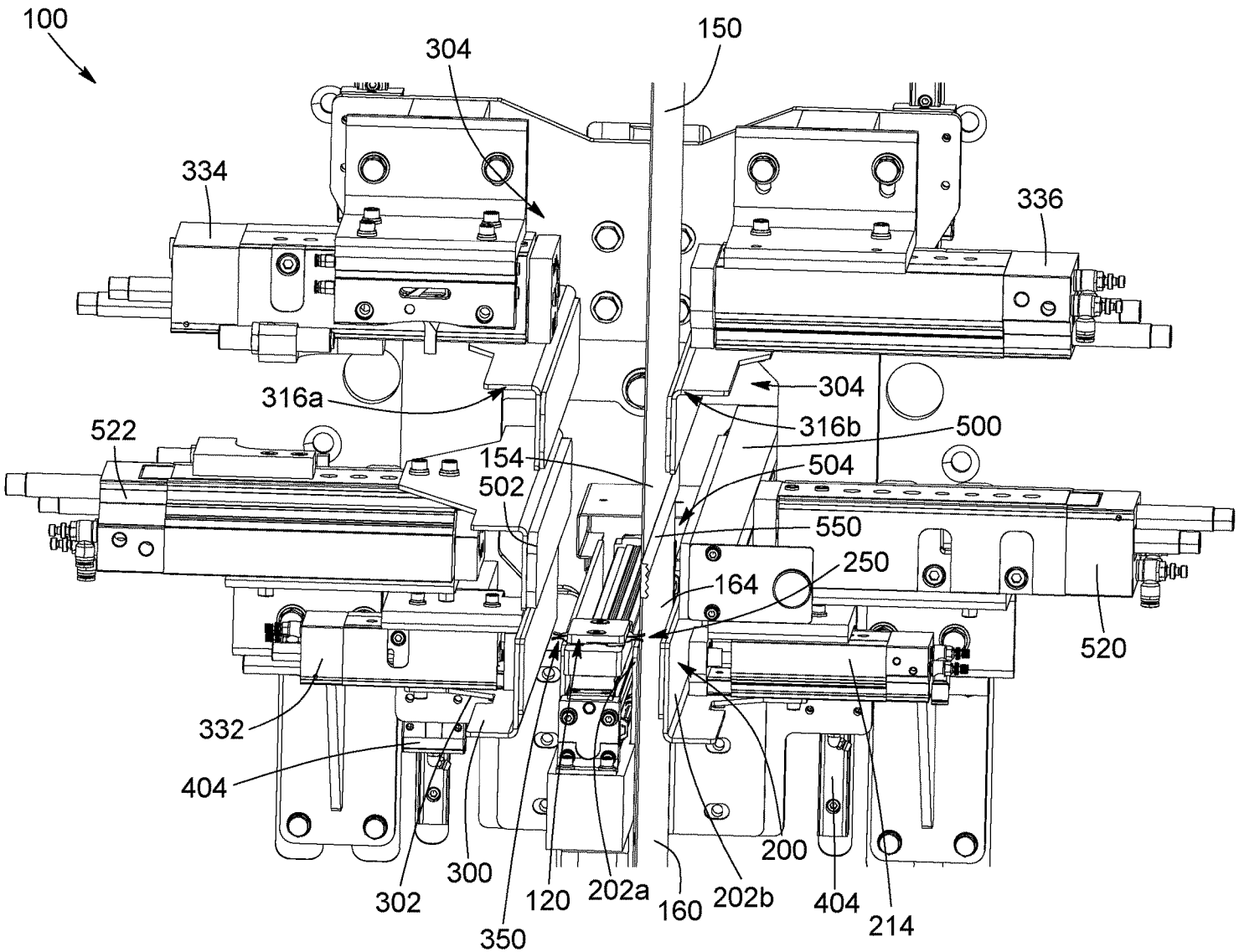
FIG. 19 is an enlarged view of a portion of the splicing apparatus of FIG. 4, with the free engaged paper sheet end being spliced with the free replenishing paper sheet end, and the replenishing sheet holder and engaged sheet holder being relaxed.

As shown in FIG. 19, all the actuators are then all deactivated, such that the engaged sheet holder 300, the replenishing sheet holder 200 and the adhesive tape applicator 500 are all unengaged. The splicing sequence is then finished. The new spliced paper becomes the new engaged paper, and the controller starts the unwinder motor operatively coupled to the paper roll axle, the replenishing sheet roll 162 being then engaged in unwinding the replenishing paper sheet 160, with the replenishing paper sheet 160 (the new engaged paper sheet) circulating through the splicing apparatus 100 to feed the manufacturing system 10. The controller further activates the accumulator motor in opposite direction to replenish the accumulator.

In a preferred embodiment, an estimated duration to perform all the steps of the splicing sequence excluding the steps of holding the replenishing paper sheet 160, cutting using the replenishing sheet cutter 250, and positioning the tape 550 on the adhesive tape applicator 500 does not exceed 5 seconds. In a most preferred embodiment, the duration is less than 4 seconds. In yet a preferred embodiment, the duration is about 3.2 seconds.

Therefore, this system prevents from stopping the production line and allows continued rotation of up to 200 m/min of unrolling the paper.

In the embodiment shown, the engaged paper sheet 150 is positioned on the left part of the splicing apparatus 100 and the replenish paper sheet 160 is positioned on the right part of the splicing apparatus 100. Therefore, at the end of the first splicing sequence, the new engaged paper sheet 150 is then positioned on the right part of the splicing apparatus 100 and the new replenish paper sheet 160 is then positioned on the left part of the splicing apparatus 100. It is understood that the splicing apparatus is completely symmetrical. In such case, after the first splicing sequence, the steps of the subsequent splicing sequence can be as follow:

The replenishing paper sheet 160 is first held by extending the lower linear actuator 332 to push the first vertical wall 310 towards the second vertical wall 312, then cut using the paper sheet cutter 120.

The engaged paper sheet 150 is then held by held by: (1) extending the replenishing holder linear actuator 214 to push the second vertical wall 206 towards the first vertical wall 210, and (2) extending the first upper linear actuator 334 (the second upper linear actuator 336 being retracted) to push the first upper jaw 316*a* towards the second upper jaw 316*b*, and then cut using the paper sheet cutter 120.

The replenishing paper sheet 160 and the engaged paper sheet 150 are then moved simultaneously upwardly to position the free engaged paper end 154 and the free replenishing paper end 164 substantially aligned with the adhesive tape applicator 500.

The upper engaged holder assembly 304 of the engaged sheet holder 300 is then moved laterally to position the free engaged paper end 154 substantially horizontally towards the free replenishing paper end 164 such that the free engaged paper end 154 and the free replenishing paper end 164 are aligned with each other and such that the engaged paper edge 156 extends substantially parallel to the replenishing paper edge 166, by extending the second upper linear actuator 336 and retracting the first upper linear actuator 334 with the free engaged paper end 154 held between the first and second upper jaws 316*a*, 316*b*.

The adhesive tape 550 is then applied by extending the tape linear actuator 520 to push the tape receiver 504 towards the abutment member 502.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A system for use in the manufacturing of paperboard corners, the system comprising:

a paper sheet processing assembly for manufacturing the paperboard corners from an engaged paper sheet engaged therein; and a splicing apparatus for splicing together the engaged paper sheet with a replenishing paper sheet, the engaged paper sheet being engaged into the paper sheet processing assembly downstream from the splicing apparatus for processing the engaged paper sheet into the paperboard corners, the splicing apparatus comprising:

an engaged sheet holder for holding the engaged paper sheet;

an engaged sheet cutter for cutting the engaged paper sheet to form a free engaged paper end having a substantially straight engaged paper edge extending substantially perpendicular to a longitudinal axis of the engaged paper sheet;

a replenishing sheet holder separate from the engaged sheet holder for holding the replenishing paper sheet;

a replenishing sheet cutter for cutting the replenishing paper sheet to form a free replenishing paper end having a substantially straight replenishing paper edge extending substantially perpendicular to a longitudinal axis of the replenishing paper sheet;

a sheet end alignment device for positioning the free engaged paper end and the free replenishing paper end relative to each other such that the free engaged paper end and the free replenishing paper end are substantially aligned with each other and such that the engaged paper edge extends substantially parallel to the replenishing paper edge; and an adhesive tape applicator distinct from the engaged and replenishing sheet holders for applying an adhesive tape simultaneously to the aligned free engaged and replenishing paper ends such that the adhesive tape extends partially over the engaged paper sheet and partially over the replenishing paper sheet to join the free replenishing paper end to the free engaged paper end;

wherein the adhesive tape applicator comprises an abutment member positionable on one side of a front end of the free replenishing paper end and the free engaged paper end aligned with each other and a tape receiver for receiving the adhesive tape with an adhesive side thereof towards the free replenishing paper end and the free engaged paper end, the tape receiver and the abutment member being movable towards each other such that the free engaged and replenishing sheet ends are sandwiched between the abutment member and the tape receiver to thereby apply the tape over the free engaged and replenishing sheet ends.

2. The system as claimed in claim 1, wherein the engaged sheet holder, the replenishing sheet holder, the engaged sheet cutter, the replenishing sheet cutter, the sheet end alignment device and the adhesive tape applicator are adapted to receive the engaged paper sheet and the replenishing paper sheet having a width of at least about 200 mm.

3. The system as claimed in claim 1, further comprising a paper accumulator located downstream from the splicing apparatus, the engaged paper sheet extending through the paper accumulator between an accumulator inlet and an accumulator outlet, the paper accumulator being configured to allow movement of the engaged paper sheet to be stopped at the accumulator inlet to allow splicing at the splicing apparatus while maintaining the engaged paper sheet in motion at the accumulator outlet to keep feeding the engaged paper sheet downstream of the paper accumulator during splicing.

4. The system as claimed in claim 3, further comprising a paper roll unwinder motor to unroll the engaged paper sheet at a speed of at least about 100 m/min when the splicing apparatus is not activated.

5. The system as claimed in claim 1, further comprising:

a remaining paper sensor to measure a remaining amount of the engaged paper sheet; and a controller operatively connected to the remaining paper sensor, the controller being configured for:

receiving a measured remaining engaged paper value from the remaining paper sensor;

comparing the measured remaining engaged paper value with a predetermined threshold; and upon determining that the remaining amount of the engaged paper sheet is below the predetermined threshold, activating the splicing apparatus.

6. The system as claimed in claim 5, wherein the paper sheet is provided on a paper sheet roll, and wherein the remaining paper sensor includes a diameter sensor for measuring a diameter of the paper sheet roll, the controller being configured to determine the remaining amount of the engaged paper sheet based on the measured diameter of the paper sheet roll.

7. The system as claimed in claim 1, wherein the splicing apparatus is configured to splice together the engaged paper sheet and the replenishing paper sheet with the engaged paper sheet having a first width and the replenishing paper sheet having a second width different from the first width.

8. The system as claimed in claim 1, wherein the engaged sheet cutter and the replenishing sheet cutter are exposed portions of a same slidable blade.

9. The system as claimed in claim 1, wherein the engaged sheet holder, the replenishing sheet holder, the engaged sheet cutter, the replenishing sheet cutter, the sheet end alignment device and the adhesive tape applicator are adapted to receive the engaged paper sheet and the replenishing paper sheet with a width of at least about 200 mm.

10. The system as claimed in claim 1, wherein the tape receiver is movable towards the abutment member in a movement direction substantially corresponding to a normal direction of the replenishing and engaged paper sheets at the free replenishing and engaged paper ends.

11. The system as claimed in claim 1, wherein the adhesive tape applicator is configured to apply the adhesive tape simultaneously along an entire width of the free engaged and replenishing sheet ends.

12. The system as claimed in claim 1, wherein the sheet end alignment device includes an alignment actuator operatively coupled to the engaged sheet holder for moving the engaged sheet holder towards the replenishing sheet holder.

13. The system as claimed in claim 1, wherein each one of the engaged sheet holder and the replenishing sheet holder includes a pair of jaw members movable towards each other to hold the corresponding sheet member therebetween.

14. The system as claimed in claim 1, wherein the paperboard corners are coreless paperboard corners.

15. The system as claimed in claim 1, wherein the tape receiver further comprises a plurality of vacuum port extending along a surface of the tape receiver to maintain a non-adhesive side of the adhesive tape in place on the surface of the tape receiver.

16. The system as claimed in claim 1, wherein the abutment member and the tape receiver have a length which is equal to or greater than a width of the free engaged and replenishing paper ends to ensure that the tape is applied over the width of the free engaged and replenishing paper ends.

17. The system as claimed in claim 1, wherein the adhesive tape applicator further comprises a tape linear actuator coupled to the tape receiver for moving the tape receiver towards an interface between the engaged paper edge and the replenishing paper edge.

18. The system as claimed in claim 17, wherein the adhesive tape applicator further comprises an abutment actuator coupled to the abutment member for moving the abutment member towards the interface between the engaged paper edge and the replenishing paper edge.

19. The system as claimed in claim 1, further comprising a tension sensor positioned adjacent the engaged paper sheet for measuring a tension of the engaged paper sheet in the system.

20. A machine configured to supply paper to a paper folding mechanism, the machine comprising:

a frame comprising a first paper roll support configured to support a first roll of paper and a second paper roll support configured to support a replenishing roll of paper;

an accumulator comprising an inlet positioned relative to the first paper roll support, an outlet, a first support, and a second support positioned opposite the first support, wherein the first support and the second support are configured to support a first paper sheet from the first roll of paper in adjacent lengths; and a paper splicer positioned relative to the outlet of the accumulator, wherein the paper splicer is configured to splice together the first paper sheet with a replenishing paper sheet from the replenishing roll of paper, the paper splicer comprising:

a first jaw movable to engage and hold the first paper sheet;

a first cutting blade movable to cut the first paper sheet to form a free end of the first paper sheet having a substantially straight first paper edge extending substantially perpendicular to a longitudinal axis of the first paper sheet;

a second jaw movable to engage and hold the replenishing paper sheet;

a second cutting blade movable to cut the replenishing paper sheet to form a free end of the replenishing paper sheet having a substantially straight replenishing paper edge extending substantially perpendicular to a longitudinal axis of the replenishing paper sheet;

an actuator operable to position the free end of the first paper sheet and the free end of the replenishing paper sheet relative to each other such that the free end of the first paper sheet and the free end of the replenishing paper sheet are adjoining one another; and an adhesive tape applicator, comprising:

a tape support configured to support a supply of adhesive tape, the adhesive tape having a first side and an adhesive side;

a support surface; and a tape receiver positioned opposite the support surface and positioned relative to the tape support, wherein the tape receiver is configured to receive the adhesive tape from the tape support with the adhesive side thereof facing the free ends of the first paper sheet and the replenishing paper sheet; and an actuator configured to move the tape receiver toward the support surface such that the free ends of the first paper sheet and the replenishing sheet are compressed between the tape receiver and the support surface to thereby simultaneously apply the adhesive tape on the free end of the first sheet and the free end of the replenishing sheet.

* * * * *